US007171911B1

(12) United States Patent
Rivera, Jr. et al.

(10) Patent No.: US 7,171,911 B1
(45) Date of Patent: Feb. 6, 2007

(54) MOBILE FOLDING TABLE HAVING A LIFTING ASSIST CENTER TORSION BAR AND LIFT OFF CASTERS

(75) Inventors: Jeremias C. Rivera, Jr., Elmhurst, IL (US); John Daniel Lazar, Munster, IN (US); Doss Samikkannu, Des Plaines, IL (US); Scott M. Zeeb, Chicago, IL (US); Philip M. Anthony, III, Chicago, IL (US)

(73) Assignee: Midwest Folding Products, Chicago, IL (US)

( * ) Notice: Subject to any disclaimer, the term of this patent is extended or adjusted under 35 U.S.C. 154(b) by 353 days.

(21) Appl. No.: 10/788,217

(22) Filed: Feb. 26, 2004

Related U.S. Application Data

(60) Provisional application No. 60/450,498, filed on Feb. 26, 2003.

(51) Int. Cl.
*A47B 3/083* (2006.01)

(52) U.S. Cl. ..... 108/169; 108/173; 108/166; 108/115

(58) Field of Classification Search ..... 108/169, 108/167, 166, 162, 163, 170, 168, 173, 174, 108/176, 177, 178, 179, 115, 121, 123, 129, 108/130, 131, 132, 133, 2; 192/33 R, 55.2
See application file for complete search history.

(56) References Cited

U.S. PATENT DOCUMENTS 2,721,778 A * 10/1955 Wilson ..... 108/173
3,075,809 A 1/1963 Wilson
3,099,481 A * 7/1963 Bue ..... 297/158.4
3,137,366 A * 6/1964 Rassier ..... 185/39
4,026,221 A * 5/1977 Wilson et al. ..... 108/169
5,028,913 A * 7/1991 Kitamura ..... 361/681
5,566,048 A * 10/1996 Esterberg et al. ..... 361/681
5,572,768 A * 11/1996 Daul ..... 16/49
5,894,633 A * 4/1999 Kaneko ..... 16/306
6,065,802 A * 5/2000 Bue ..... 297/158.4
6,070,298 A * 6/2000 Sorimachi ..... 16/330
6,186,591 B1 * 2/2001 Pajerski ..... 297/159.1
6,223,661 B1 5/2001 Griepentrog
6,952,860 B2 * 10/2005 Kawamoto ..... 16/285
2003/0025375 A1 * 2/2003 Gray ..... 297/367

* cited by examiner

*Primary Examiner*—Janet M. Wilkens
*Assistant Examiner*—Timothy Ayres
(74) *Attorney, Agent, or Firm*—McDermott Will & Emery LLP

(57) ABSTRACT

There is provided an apparatus for a folding table assembly comprising a lifting assist center torsion bar assembly, a lift off caster assembly and a stability locking mechanism. A folding table assembly with a lifting assist mechanism provides a lifting assist force during a portion of the folding process of a foldable table from an unfolded use position to a folded storage position. A lift off caster assembly maintains an unfolded table assembly in a stationary position and prevents the unfolded table from wandering or deviating from its original location on the floor. There is also provided a stability locking mechanism that can set the folding table in a folded and stable semi-closed position.

6 Claims, 24 Drawing Sheets

DETAIL A

SECTION C-C

DETAIL B

DETAIL C

SECTION D-D

DETAIL D

MOBILE FOLDING TABLE HAVING A LIFTING ASSIST CENTER TORSION BAR AND LIFT OFF CASTERS

CROSS REFERENCE TO RELATED APPLICATIONS

The present application claims the benefit of U.S. provisional patent application No. 60/450,498, filed on Feb. 26, 2003 and titled "Mobile Folding Table Having a Lifting Assist Center Torsion Bar and Lift Off Casters".

FIELD OF THE INVENTION

The present invention generally relates to folding table assemblies. More particularly, the present invention relates to a lifting assist assembly for a folding table and a means for maintaining the location or position of the folding table when in an unfolded and operative or use position.

BACKGROUND OF THE INVENTION

Folding roll-away tables having seating structures are know in the art, for example as disclosed in U.S. Pat. Nos. 6,223,661 and 3,075,809, the disclosures of both of which are hereby incorporated by reference. Such foldable tables have lifting assist mechanisms intended to assist an operator during the folding of a folding table from an unfolded use position to a folded storage or moving position. Existing lifting mechanisms typically use one or more torsion bars for providing lifting assistance to the operator. Two to four torsion bars are employed in a typical torsion bar lifting assist mechanism. The torsion bars are typically attached to the table frame on one end of the torsion bar and attached to a hinge tube of a leg assembly at the other end of the torsion bar. Each torsion bar stores energy that will be used to fold the table assembly. Torsion bar holders are attached to the table frame and have a hexagonal hole configuration that solidly accepts and locks one end of the torsion bar to the table frame assembly. In this manner, the attached torsion bar end is solidly positioned and not allowed to twist with respect to the table frame at this point. The opposite end of the torsion bar is solidly attached to the hinge tube of a leg assembly with a second hexagonal torsion bar holder. With this end of the torsion bar firmly attached to the leg assembly, the torsion bar will twist as the leg assembly rotates with respect to the table frame when the folding table assembly is unfolded between the storage and use positions. In existing foldable tables, the torsion bars typically twist or rotate throughout a range of ninety degrees (90°) during the unfolding or folding operation. Other lifting assist mechanisms using torsion bars may twist through a greater or lesser angular range depending on the torsion bar construction.

During the unfolding process of existing foldable table assemblies from a folded or storage position to an open unfolded use position, the operator unfolds the foldable table and thereby stores potential energy in the torsion bars. The operator-applied force and the force of gravity acting on the table assembly overcomes the natural tendency of the torsion bars to remain in an untwisted state as the table unfolds. As the table assembly unfolds, the free ends of the torsion bars are twisted through ninety (90) degrees as the table legs swing out to an open position and thereby store enough energy in the torsion bars to later release the stored energy to fold the table.

To initiate the folding process from an unfolded or use position to a closed or folded storage position, a small input force is required from the operator. The initial operator input force is necessary since the folding table tends to want to fold due to the stored energy in the torsion bars. The folding table assembly needs a locking mechanism to keep the folding table in a flat and unfolded use position. Typical foldable table designs, such as those described in U.S. Pat. Nos. 6,223,661 and 3,075,809, require a small operator input force of about ten (10) to twenty (20) pounds of force vertically applied at the midpoint of the foldable table assembly near the center hinge point to initiate the folding sequence.

Existing lifting assist torsion bar designs, however, have drawbacks associated with them. For example, the amount of force needed to close the table varies as it closes, so that more force is needed, either from the operator or the torsion bars, when the table begins to fold away from its unfolded use position than when it approaches the fully folded storage position. Existing designs attempt to provide the required force by attempting to balance the amount of torque induced by the torsion bars with the weight of the table as it is being folded or unfolded. However, if too much force is added near the top of the table's travel, the table will snap shut causing a potential safety hazard as well as unnecessary wear and tear. Further it would be difficult to pivot the two halves of the tables as an operator starts to unfold the table. If there is insufficient force near the top of the table's travel, the table will "feel" heavy as the operator tries to fold it. Thus, additional lifting force would be beneficial in assisting the operator at the beginning of the folding process but is not necessary at the end of the folding process as the table approaches its folded position.

Existing mobile folding tables typically have stool-style seat structures with wheeled casters positioned directly underneath the stool seat post of the end leg assembly, for example as disclosed in U.S. Pat. No. 3,075,809. In this end leg configuration, the casters always maintain contact with the floor irrespective of whether the folding table assembly is folded, unfolded or in a position therebetween. The tendency of the lifting assist torsion bar assembly is to fold the table from an unfolded position, thus the center legs will tend to rise off the floor. When the center legs rise and lose contact with the floor, so too do the gripping pads at the base of the seating stool tubes. This results in the weight of the table being shifted mostly to the wheeled caster which further results in movement or wandering of the unfolded table from its original location.

Additionally, if weight is concentrated near or at the ends of the folding table assembly or directly over the wheeled casters, the center legs also tend to rise off the floor, also resulting in movement or wandering of the unfolded table from its original location. Existing folding tables, having wheeled casters on the end leg assemblies are prone to shift or wander in the unfolded use position, especially on hard floor surfaces. This can be a significant problem in certain use environments such as in school cafeterias and the like where hard flooring surfaces such as vinyl tile is common. Further, manufacturing tolerances, clearances, and the inherent flexibility in the table structure increases the likelihood that the table will deviate or wander from its original unfolded location on the floor.

There is thus a need for a folding table assembly with a lifting assist mechanism that will provide an assist lifting force primarily during the beginning of the folding process of the foldable table assembly from an unfolded use position to a folded storage position. There is also a need for a mechanism that will assist in maintaining an unfolded table assembly in a stationary position and to prevent the unfolded table from wandering or deviating from its original location on the floor.

SUMMARY OF THE INVENTION

The present invention provides a folding table assembly for assisting in the transition of a folding table between an open position and a closed position. The folding table assembly includes a center torsion bar mechanism having a clutch mechanism and a center torsion bar coupled to the folding table such that the folding table folds about the center torsion bar as the table is moved between the open and closed positions. The center torsion bar is preferably fixed to the folding table at a first end and moveably coupled to the folding table at an opposite second end via the clutch mechanism. The clutch mechanism engages the center torsion bar at a first semi-folded position as the table is unfolded from the closed position. The center torsion bar stores folding potential energy between the first semi-folded position and the open position as teh folding table continues unfolding to the open position. The center torsion bar is adapted to provide a lifting force between the open position and a second semi-folded position as the folding table is folded from the open to the closed position. In one embodiment, the first semi-folded position and the second semi-folded position are identical table positions. The lifting force is provided via release of the stored folding potential energy in the center torsion bar until the clutch mechanism disengages the center torsion bar at the second semi-folded position as the table continues to fold to the closed position. There lifting assist mechanism provides an assist lifting force during the beginning of the folding process of the foldable table assembly from an unfolded use position to a folded storage position.

The folding table assembly can further include a lift off caster assembly that assist in maintaining the unfolded table assembly in a stationary position and preventing the unfolded table from wandering or deviating from its original location on the floor. The lift off caster assembly has a plurality of lift-off rollers coupled to table end leg assemblies. The plurality of rollers are adapted to support the folding table and facilitate folding of the folding table. The plurality of rollers are also adapted to lift-off from a table supporting structure when the folding table reaches the open position enabling the center and end table leg assemblies to land and support the folding table. The plurality of rollers also contact the floor and lift the center and end table leg assemblies from the supporting structure, e.g., the floor, as the folding table is folded from the open to the closed position.

In one aspect of the present invention a center torsion bar for a foldable table assembly provides lifting assistance to an operator during the beginning of the folding process from an unfolded use position to a folded storage position.

In another aspect of the present invention a mechanism is provided to assist in maintaining an unfolded table assembly in a stationary position.

In an additional aspect of the present invention a mechanism is provided to prevent the unfolded table from "wandering" or deviating from its original location on the floor.

In still a further aspect of the present invention a graduated torsion bar assist mechanism increases the efficiency of the torsion assist mechanism throughout the folding table's range of motion while lifting the caster wheels off the floor when the table assembly is opened and unfolded.

In another aspect of the present invention a center torsion bar assembly matches efficiently the amount of energy provided by the torsion bars to the amount of force actually needed during the table's travel from fully folded to fully unfolded and vice versa.

In a further aspect of the present invention a center torsion bar assembly provides lifting assistance to an operator for folding the table assembly using a reduced number of torsion bars used in the lifting assist assembly.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which.

DETAILED DESCRIPTION

Figure 6:
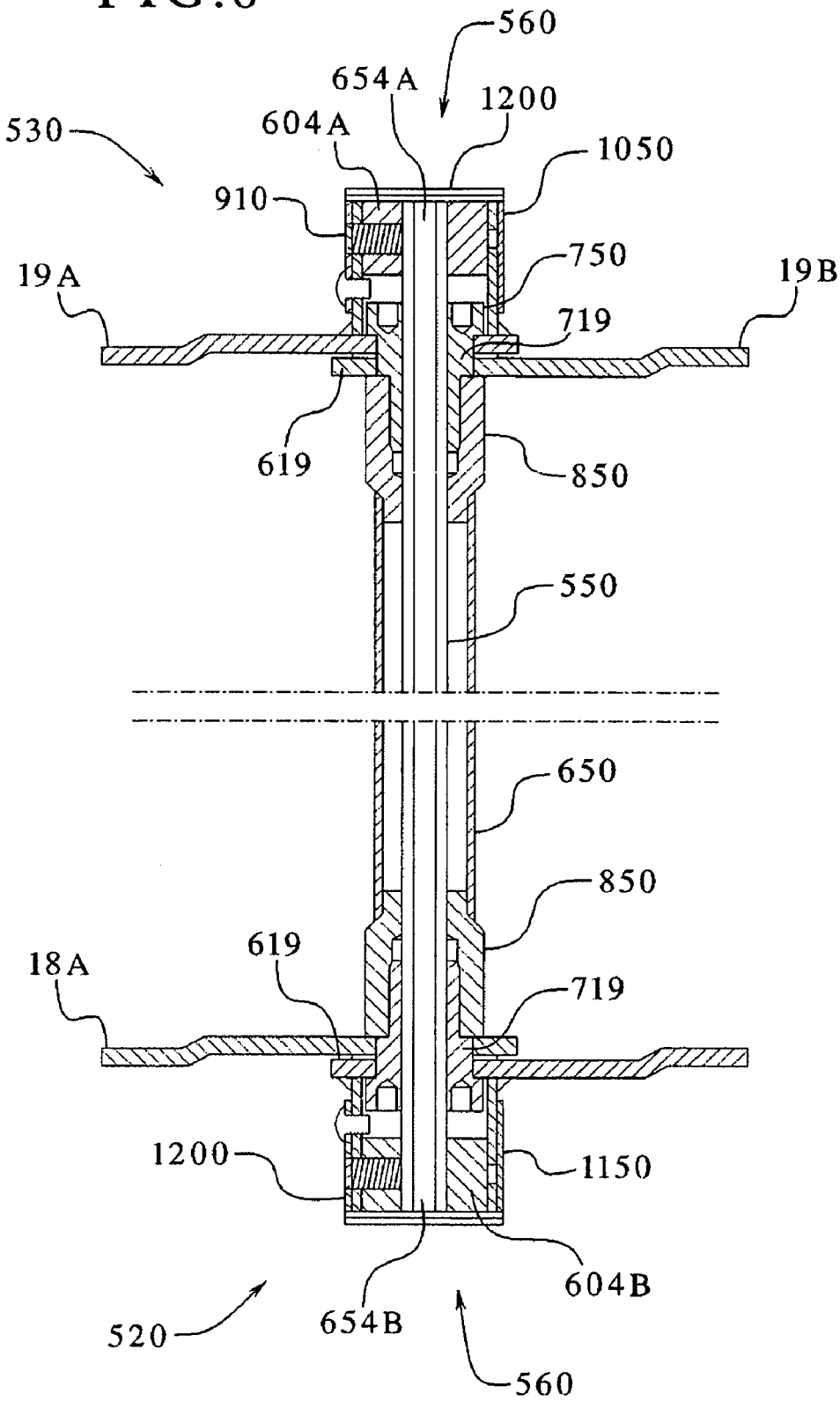
FIG. 6 illustrates a partial view of the center torsion bar assembly of FIG. 5C according to an embodiment of the present invention.

FIGS. 1A, 1B, 1C and 1D show isometric, front, bottom and side views of an unfolded mobile folding table assembly 100 comprising a center torsion bar assembly 600, shown in FIG. 6, and a plurality of lift-off casters 30, according to one embodiment of the present invention. The mobile folding table assembly 100 preferably folds along a center axis 10 defined by two hinge points 15 and 17 contained in the frame of two table halves or sections 5A and 5B. Each table section 5A and 5B is generally rectangular and is made of material such as wood or plastic, and is fastened to a corresponding table frame structure 20A and 20B that runs the length of each table section 5A and 5B. Each table frame structure 20A and 20B comprise two rails 25A, 25B, 27A and 27B that are positioned inward and away from the edge of the table sections 5A and 5B. The table frame rails 25A, 25B, 27A and 27B serve as location points for the hinge tubes 205 and 305 of each leg assembly 200 and 300, shown in FIGS. 2A–2C and 3A–3C, as well as a support structure for the table section tops 5A and 5B. A number of leg assemblies 200 and 300 are attached to each table section 5A and 5B at table frame structure attachment location points 23A, 23B, 29A and 29B. Each leg assembly 200 and 300 pivots about its respective location point 23A, 23B, 29A or 29B along an axis defined by a leg hinge tube 205 or 305 running across the top of each leg assembly 200 and 300, respectively.

Figure 1A:
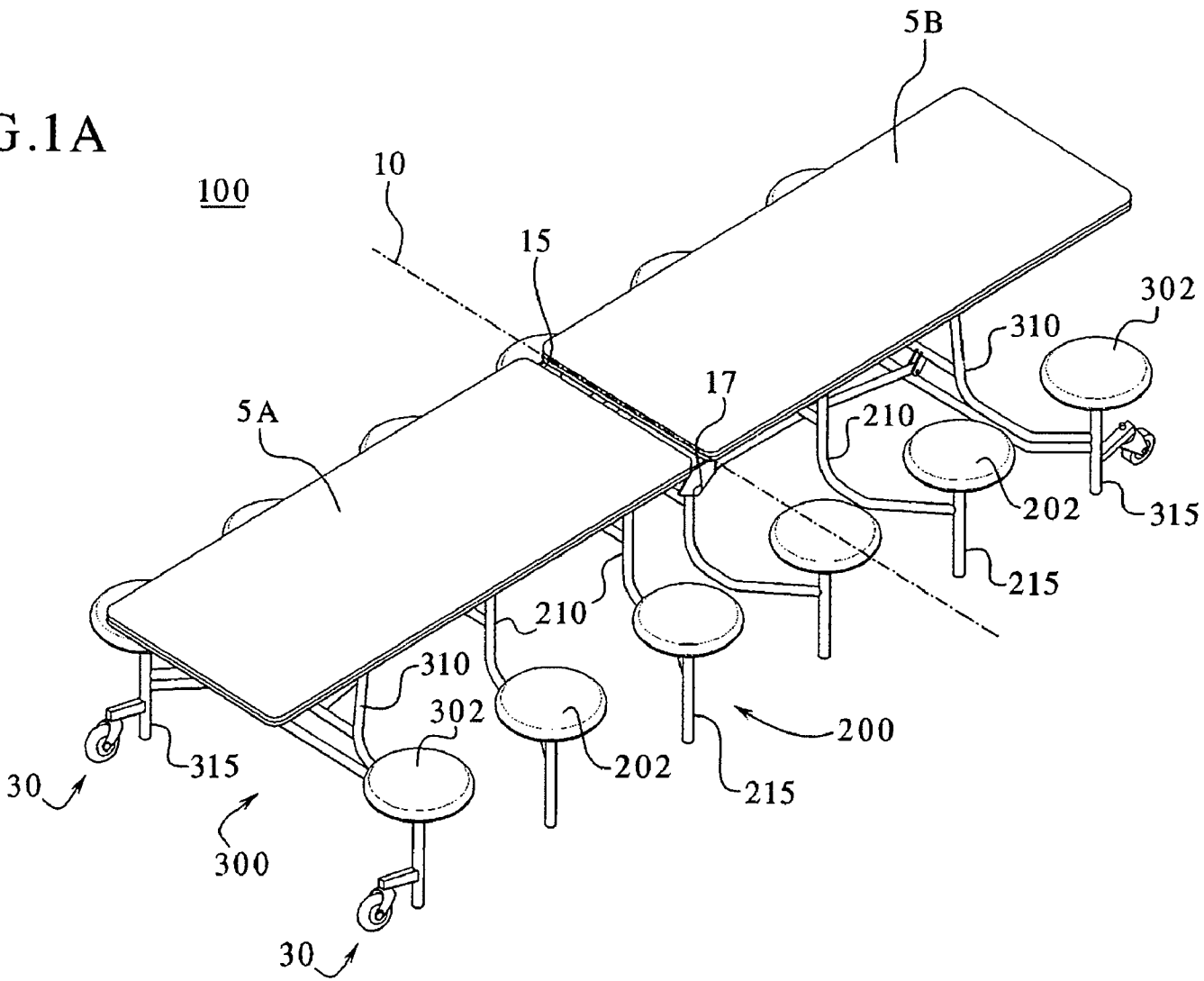
FIGS. 1A, 1B, 1C and 1D illustrate isometric, front, underside and side views of an unfolded folding table assembly with a center torsion bar assembly and lift-off casters according to an embodiment of the present invention.
Figure 1B:
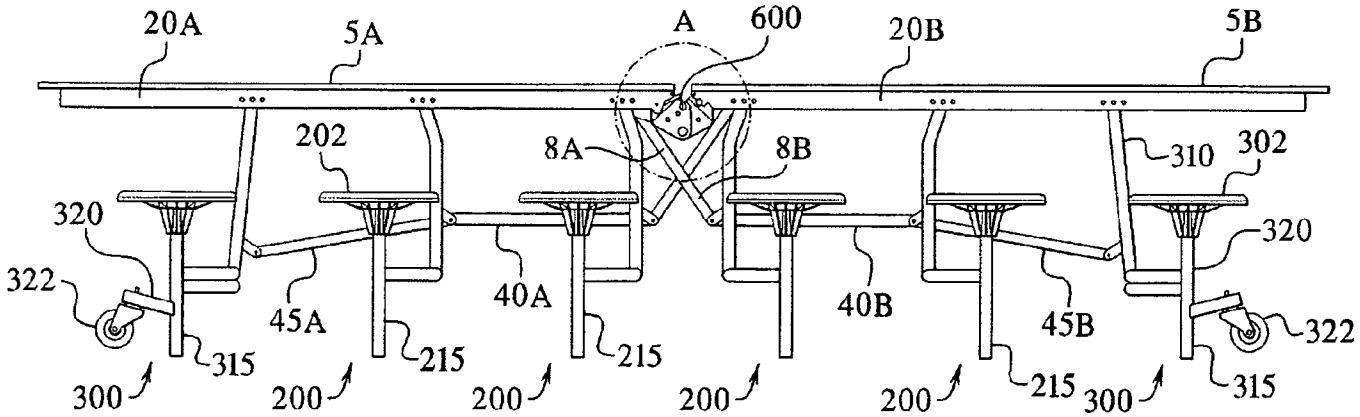
Figure 1D:
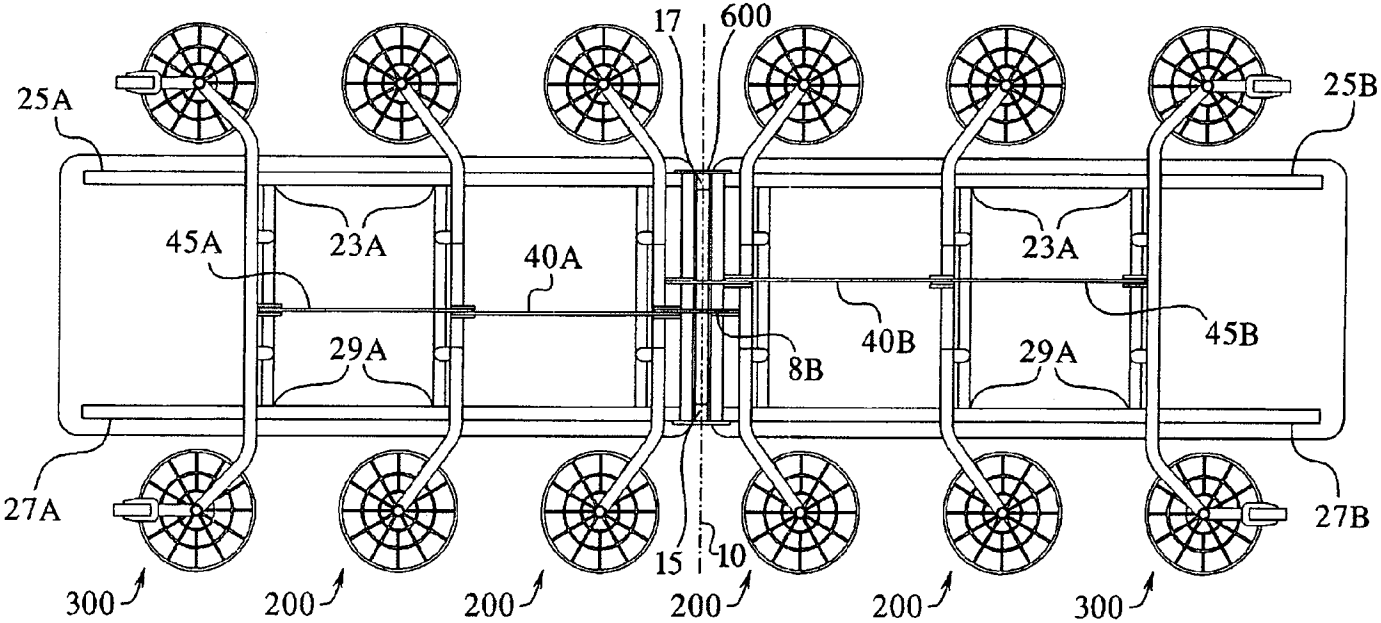
Figure 1C:
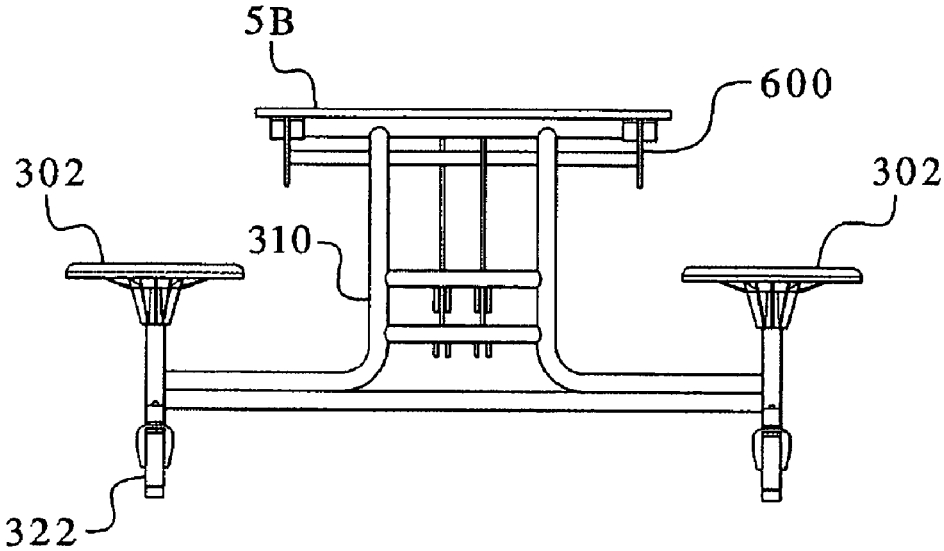
Figure 1E:
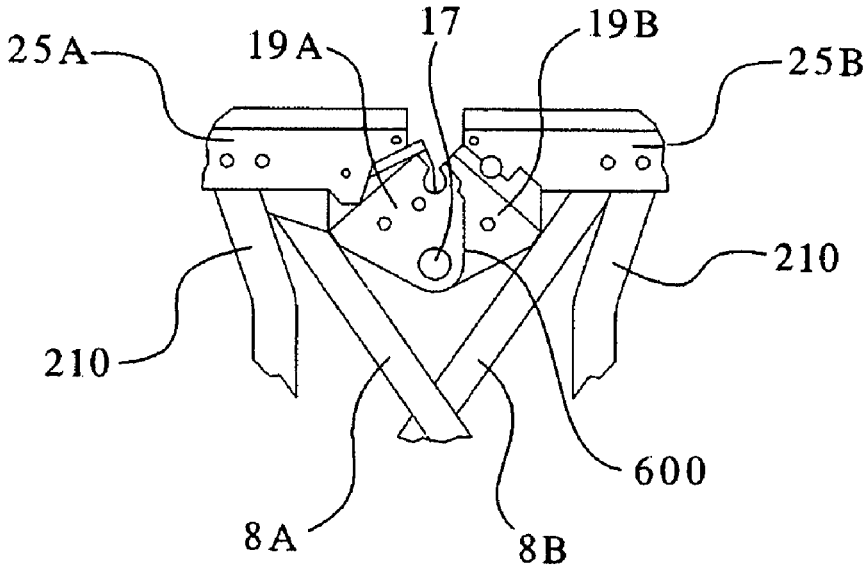
FIG. 1E illustrates Detail A of a center pivot point for the folding table assembly of FIG. 1B.

FIG. 1E shows Detail A of a center hinge or pivot point 17 for the mobile folding table 100 of FIG. 1B. There are shown opposing table frame structures rails 25A and 25B connecting to respective hinge plates 19A and 19B which pivot about the center hinge point 17. FIG. 1E also partially shows a pair of short drive links 8A and 8B that connect a center leg assembly 200 nearest the central hinge location 17 of the mobile folding table 100 to the table frame section 20A and 20B of the opposite table section 5B and 5A of the mobile folding table 100. The short drive link 8A and 8B relates the motion of one table section 5A or 5B of the folding table 100 to the opposite table section 5B or 5A as the table sections 5A and 5B pivot around the central hinge point 17. As a result, each table section 5A and 5B of the folding table 100 closes simultaneously and in a mirror manner to the other opposite table section 5A and 5B as the mobile folding table 100 is either folded or unfolded.

Figure 5D:
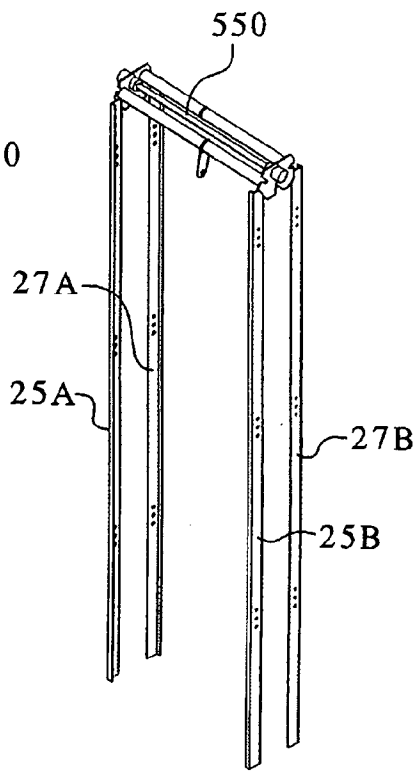
FIG. 5D illustrates an isometric view of the center torsion bar assembly for the folding table assembly of FIGS. 4A–4B in a one hundred eighty degrees (180°) position according to an embodiment of the present invention.
Figure 5B:
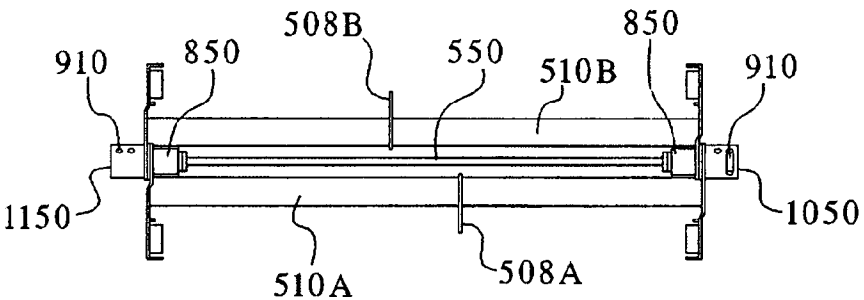
FIGS. 5A and 5B illustrate front and enlarged top views of a center torsion bar assembly for the folding table assembly of FIGS. 4A–4B according to an embodiment of the present invention.
Figure 5C:
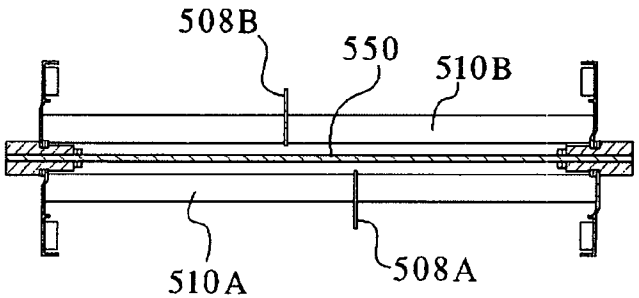
FIG. 5C illustrates an enlarged top section view along the line C—C of the center torsion bar assembly of FIG. 5A.

The short drive links 8A and 8B connect the table frame assembly 20A and 20B to the nearest center leg assembly 200 at a center tube yoke 508A and 508B, shown in FIGS. 5B and 5C, which are welded, or otherwise securely attached, to a cross center tube 510A and 510B linking the table frame rails 25A, 25B, 27A and 27B of each table section 5A and 5B. The position of the center tube yokes 508A and 508B and the relative angle and length of the short drive link 8A and 8B, as it connects to each center leg assembly 200, determine the folding and unfolding characteristics of the mobile folding table 100.

The short drive link 8A and 8B and a second connecting center drive link 40A and 40B are pinned at the center leg open yoke 240 on the central-most center leg assemblies 200. The total number of center leg assemblies 200 used in the mobile folding table 100 will determine the length of the second center drive link 40A and 40B. If a second or third center leg assembly 200 is required on a table section 5A and 5B, the second center drive link 40A and 40B will horizontally connect the additional center leg assemblies 200 to the central-most leg assemblies 200. All of the center leg assemblies 200 are preferably identical in construction and therefore the center leg yoke points are all identical and will pass horizontally through the open yokes 240 on each center leg assembly 200. As a result, each of the center leg assemblies 200 will pivot in synchronization with its twin center leg assembly 200 on the opposite table section 5A and 5B of the folding table 100 and will rotate through the same number of degrees, at the same rate, as any other center leg assembly 200 immediately inboard of it.

Figure 4B:
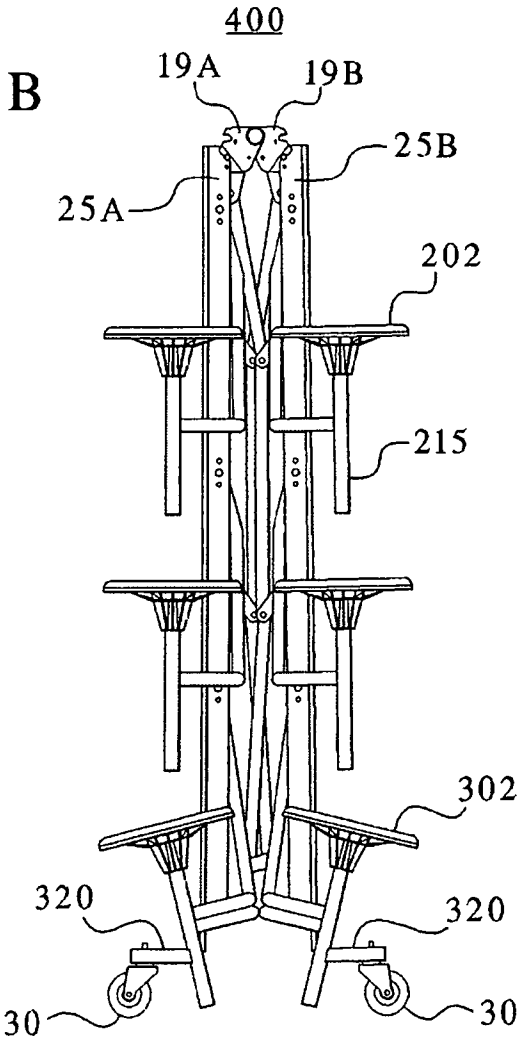
FIGS. 4A and 4B illustrate front and side views of the folding table assembly of FIGS. 1A–1D in a folded position.
Figure 4A:
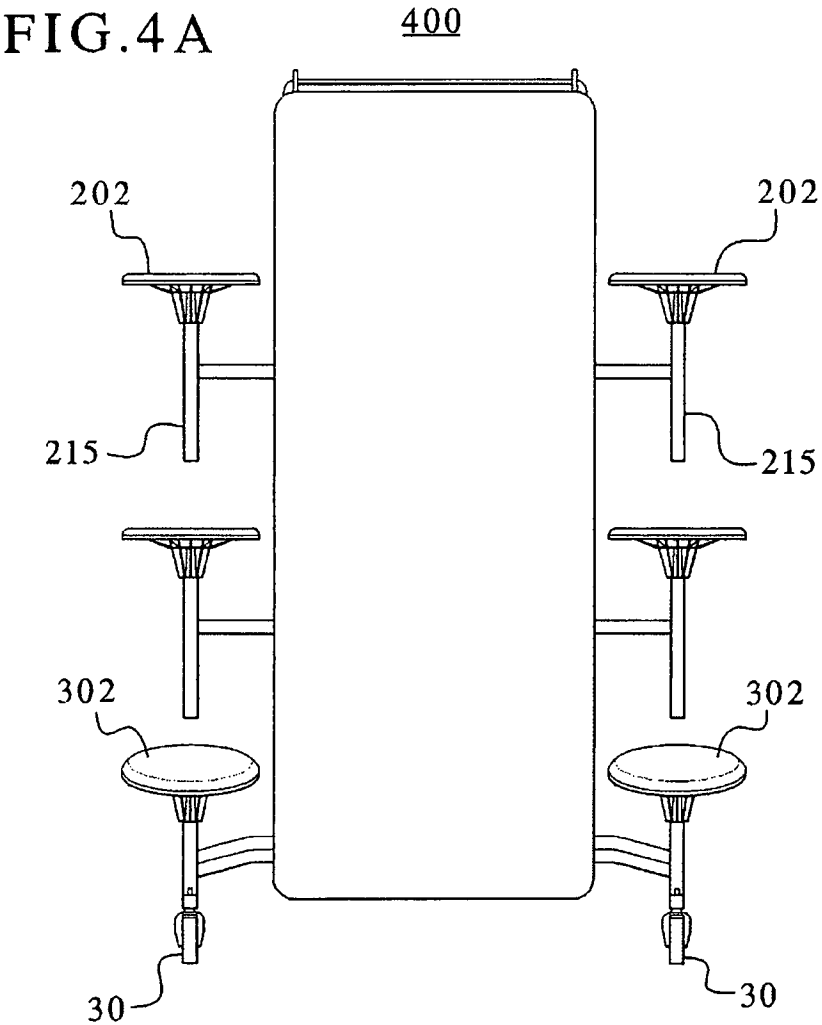

As the table is being folded, for example from an unfolded position shown in FIGS. 1A–1C to a folded position shown in FIGS. 4A and 4B, the system center drive links 40A and 40B and the end leg drive links 45A and 45B rotate the table leg assemblies 200 and 300 in unison underneath the table tops until they are substantially parallel to the table tops 5A and 5B and table frame structure 20A and 20B.

Figure 2A:
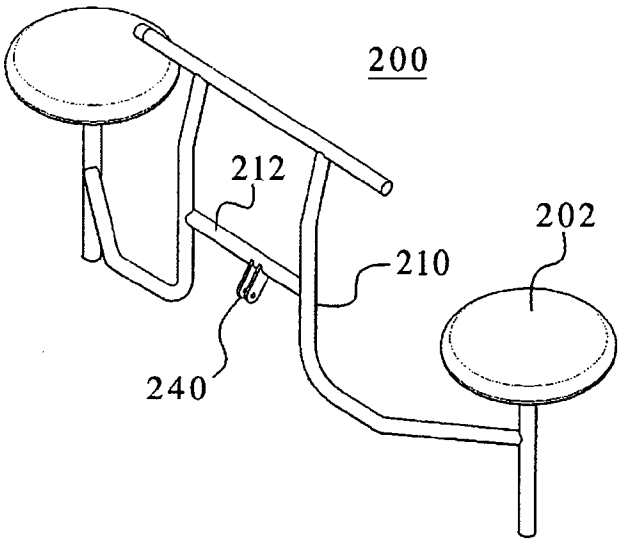
FIGS. 2A, 2B and 2C illustrate isometric, front, side and section A—A views of a center leg assembly for the folding table assembly of FIGS. 1A and 1B according to an embodiment of the present invention.
Figure 2C:
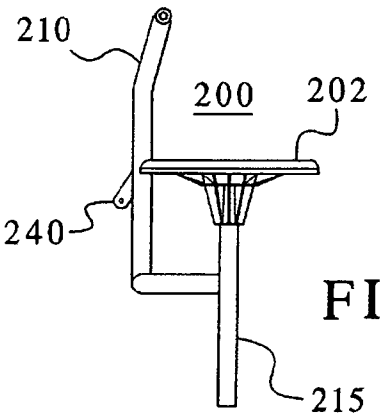
Figure 2B:
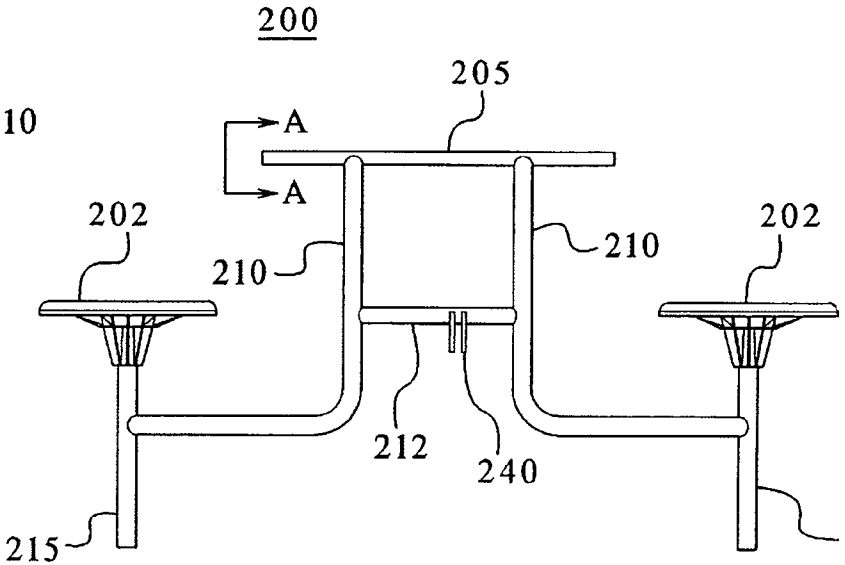
Figure 3A:
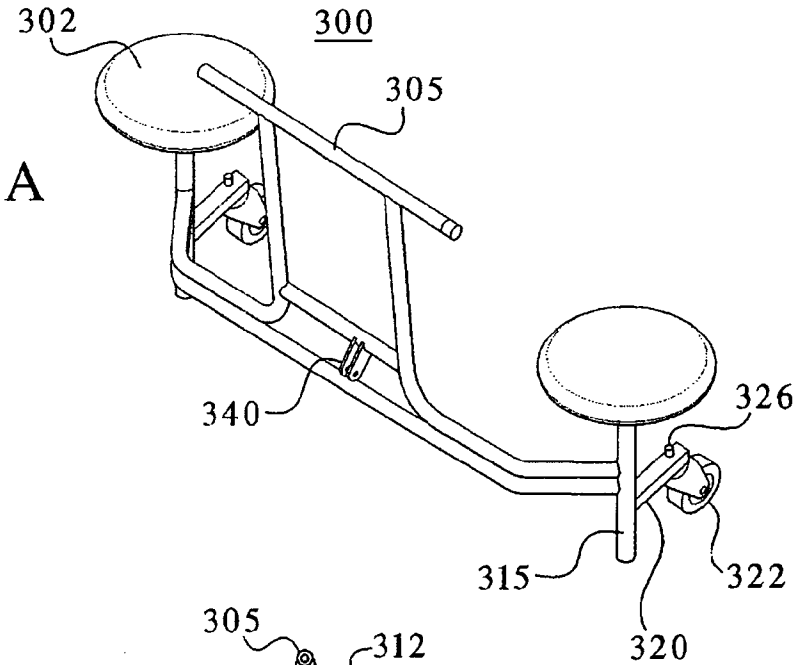
FIGS. 3A, 3B and 3C illustrate isometric, front and side views of an end leg assembly for the folding table assembly of FIGS. 1A–1D according to an embodiment of the present invention.
Figure 3C:
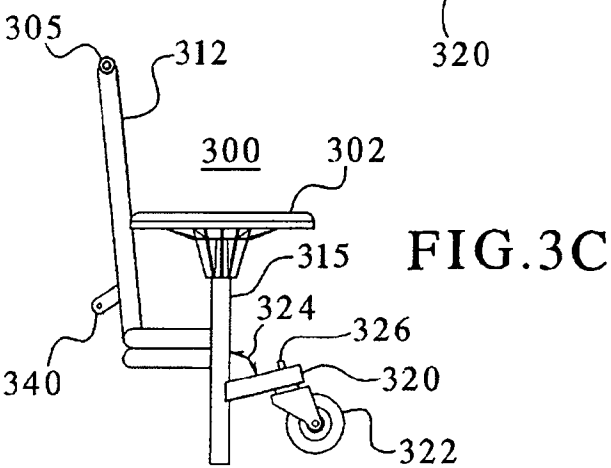
Figure 3B:
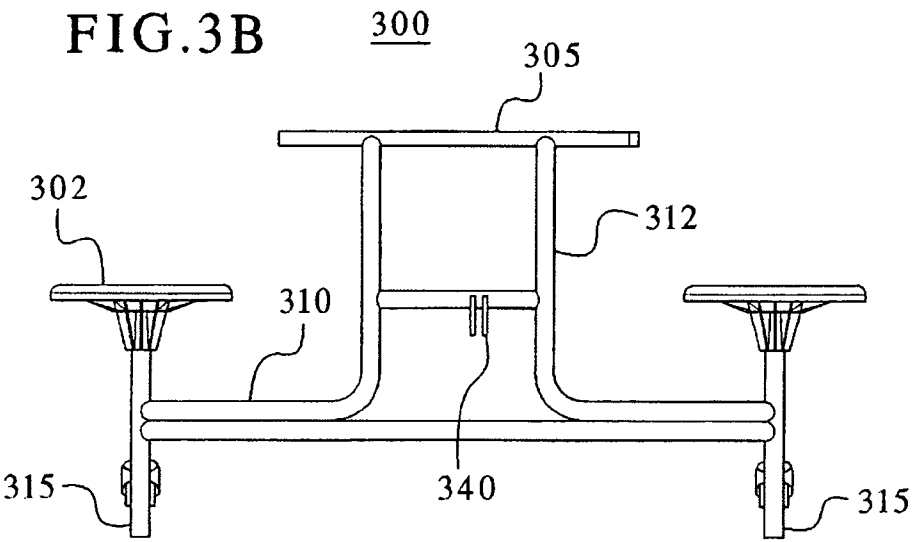

FIGS. 2A–2C show an embodiment of the center leg assembly 200 for the folding table assembly 100 of FIGS. 1A–D. FIGS. 3A–3C show an embodiment of the end leg assembly 300 for the folding table assembly 100 of FIGS. 1A–D. The mobile folding table 100 can comprise a plurality of center and end leg assemblies 200 and 300. preferably, the center leg assemblies 200 can number as few as one or as many as three per folding table section 5A or 5B. Two center leg assemblies 200 are shown for each table section 5A and 5B in the embodiment shown in FIGS. 1A–1C. All center leg assemblies 200 are identical to each other and comprise a stool post 215 and tubular structure 210 to connect two stools 202 to linkage points and pivot points 23A, 23B, 29A and 29B on the table frame structure 20A 20B, and undercarriage of the mobile folding table 100. The center leg assemblies 200 are connected to the table frame structure 20A and 20B at their respective pivot locations 23A, 23B, 29A and 29B, and are also connected to a system of drive links or center drive link bars 40A or 40B, shown in FIGS. 1B and 1D, via an open yoke 240 offset from the centerline of the mobile folding table 100.

The end leg assemblies 300 are identical to each other and comprise a stool post 315 and tubular structure 310 to connect two stools 202 to the linkage points and pivot points 23A, 23B, 29A and 29B on the table frame structure 20A or 20B, and the undercarriage of the mobile folding table 100. The end leg assemblies 300 are connected to the table frame structure 20 or 20B at their respective pivot locations 23A, 23B, 29A and 29B, and are also connected to end leg drive links 45A or 45B, shown in FIGS. 1B and 1D, via an open yoke 340 offset from the centerline of the mobile folding table 100.

The end leg assemblies 300 are connected to the mid or central-most center leg assemblies 200 by an end leg drive link 45A or 45B, shown in FIGS. 1B and 1D, that extends from a pinned connection at the nearest center leg assembly 200 to the end leg's open yoke 340. The end leg connecting drive link 45A or 45B connects to the end leg 300 and cannot extend horizontally to the yoke position 340 as is the case with the center legs assemblies 200. The end leg connecting drive link 45A or 45B connecting to the end leg 300 is pinned at the open yoke 340 that is lower vertically in relation to the open yoke 240 of the center leg assemblies 200. The end leg connecting drive link 45A or 45B is preferably shorter in length and is oriented to extend downward at an angle relative to the center drive link bars 40A and 40B in order to change the rate and the range each end leg assembly 300 rotates through as the mobile foldable table 100 is folded or unfolded.

End leg assembly 300 comprises a pair of stool posts 315 that extend completely to the floor and caster wheels 30 that are located above the floor when folding table 100 is in the unfolded position as shown in FIGS. 1A–1D. In this manner, all the stool posts 215 and 315 of the folding table 100 contact the floor when the folding table is in an unfolded position thereby reducing the likelihood that the table will wander from its original set up location.

The end leg casters 30 are preferably mounted to caster tubular spur extensions 320 of the stool post 315 on each end leg assembly 300. The caster tube 320 preferably has a rectangular or square cross-section and is mounted at an angle 324 to the stool post 315. The caster tube angle 324 of the caster tube 320 to the stool post 315 is preferably such that, in the unfolded table position, the caster wheel 322 does not touch or only slightly contacts the floor irrespective of the position that the caster wheel 322 may be rotated on its stem 326. The caster tube angle 324 between caster tube 320 and the stool post 315 is preferably determined by the folded position of the mobile table when it is locked for normal maneuvering and storage. The casters 30 are preferably mounted such that the caster tube 320 is parallel to the floor and the hole drilled for the caster stem 326 is perpendicular to the floor since it is easiest to maneuver a set of casters 30 when the axis of rotation of the caster stem 326 is perpendicular to the ground. The caster wheels 322 will then freely follow a travel path as intended by an operator as he or she maneuvers the folded mobile table 100.

The cross-section of the caster tube 320 is preferably rectangular in order to facilitate the easy and stable mounting of the caster 30 to the end leg assembly 300. A round caster mounting tube 320 could be used, but may cause a caster stem 326 to bend about the axis of the caster tube 320 thereby shortening the life of the caster and increasing the likelihood of failure of the caster 30. The caster stem 326 is fastened through a hole placed in the caster tube 320 at a distance along the caster tube 320 away from the stool post 315. The hole is preferably placed as near as possible to the stool post 315 in order to minimize the moment created by cantilevering the caster tube 320 off the stool post 315. The farther the caster stem 326 is located from the stool post 315, the greater the bending moment introduced to the caster tube 320. High bending moments can cause the tubular structure 310 of the end leg 300 to flex or sag under the combined weight of the mobile folding table 100 which disadvantageously decreases the distance the stool post 315 is lifted off the ground during folding of the mobile table 100. The requirement of lifting the end leg 300 off the floor preferably determines the minimum distance the caster 300 can be mounted away from its stool post 315.

Further, the upright end leg tubes 312 on each end leg assembly 300 are configured differently from the center leg assemblies 200 in order to facilitate the rotational characteristics required for the end leg assemblies 300 as the mobile table 100 folds and unfolds. The end leg uprights 312 are preferably skewed at an angle of five degrees (5°) from vertical, however the leg may be skewed at another angle depending on the particular configuration of the mobile foldable table. The skewed configuration of the end leg uprights 312 allows for a shorter distance between pivot points 23A, 23B, 29A and 29B of the end leg assembly 300 and the adjacent center leg assembly 200 on the table frame structure 20A or 20B while at the same time allowing leg assembly stool seats 202 and 302 to be spaced at regular intervals.

FIGS. 4A and 4B illustrate front and side views of the folding table assembly 400 of FIGS. 1A–1D in a folded or storage position. In this configuration, the folded table 400 is preferably supported by the wheeled casters 30 of the end leg assemblies 300. In moving form an unfolded position, as shown in FIGS. 1A–1D, to the folded table position 400, the end legs 300 rotate such that they are tucked under the mobile table 100 as it is folded. The torsion bar assemblies in the mobile table release their stored energy that was obtained during unfolding of the mobile table 100. The release of the stored torsion bar energy enables the mobile table 100 to fold under its own power.

In one embodiment, a torsion bar 550, shown in FIGS. 5A–5D, is preferably located concentric to the central plate hinges 19A and 19B of the mobile folding table 100 as shown in FIGS. 1A, 1B and 1E. Two other torsion bars are mounted concentric to the hinge tubes 205 of the center leg assemblies 200 and are allowed to pivot on the table sections 5A and 5B. The torsion bars mounted inside the leg assemblies 200 are rigidly fastened to the fame structure 20A and 20B in a fashion and manner consistent with existing folding table designs which are well known to those of ordinary skill in the art. The torsion bars of the center leg assembly 200 transmit stored energy to the opposite table section 5A or 5B of the mobile folding table 100 via the pin connection at the open yoke 240 in the leg assembly 200 and the system of drive links 40A, 40B, 45B and 45B connected to the opposite table section 5A or 5B.

Figure 5A:
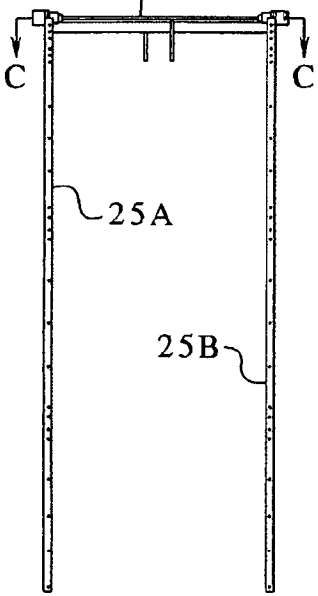

FIGS. 5A, 5B and 5D show the center torsion bar assembly 600 for the folding table assembly 100 and 400 of FIGS. 1A–1E and 4A–4B in a one hundred eighty degree (180°) position according to one embodiment of the present invention. FIGS. 5C and 6 show an enlarged partial top section view along the line C—C of the center torsion bar assembly of FIG. 5A.

The torsion bar assembly 600 with its center torsion bar 550 is preferably located at the central hinge 17 and is mounted directly to the table frame structure 20A and 20B at one end 520 and is rigidly connected to the frame via a clutch mechanism 560 at the other end 530. The clutch mechanism 560 is preferable use to prevent the center torsion bar 550 from rotating through one-hundred eighty degrees (180°) as the mobile table 100 or 400 travels from a completely unfolded open position to a completely folded closed position which would be the case if the center torsion bar 550 were to be fastened by existing conventional methods. The clutch mechanism 560 prevents the center torsion bar 550, which is typically spring steel or some other medium to high carbon alloy steel, from experiencing excessive plastic deformation when the center torsion bar 550 is twisted past ninety degrees (90°).

The clutch mechanism 560 preferably allows only ninety degrees (90°) of rotation in the center torsion bar 550. This aspect will maintain the stresses experienced by the center torsion bar 550 material as low as possible and thereby increase the life span of the center torsion bar 550 and the center torsion bar assembly 600.

Figure 13A:
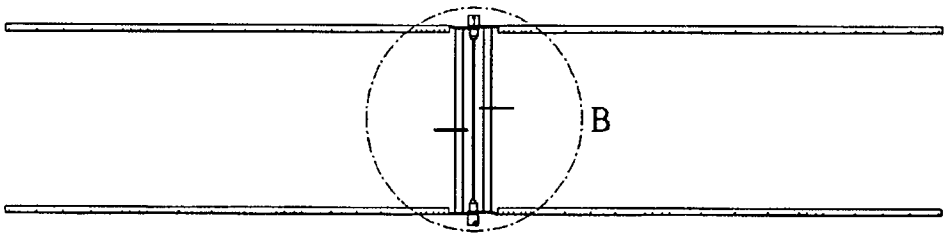
FIGS. 13A and 13B illustrate top and isometric views of the center torsion bar assembly for the folding table of FIGS. 1A–1D and 4A–4B in a ninety degree (90°) position according to an embodiment of the present invention.
Figure 13B:
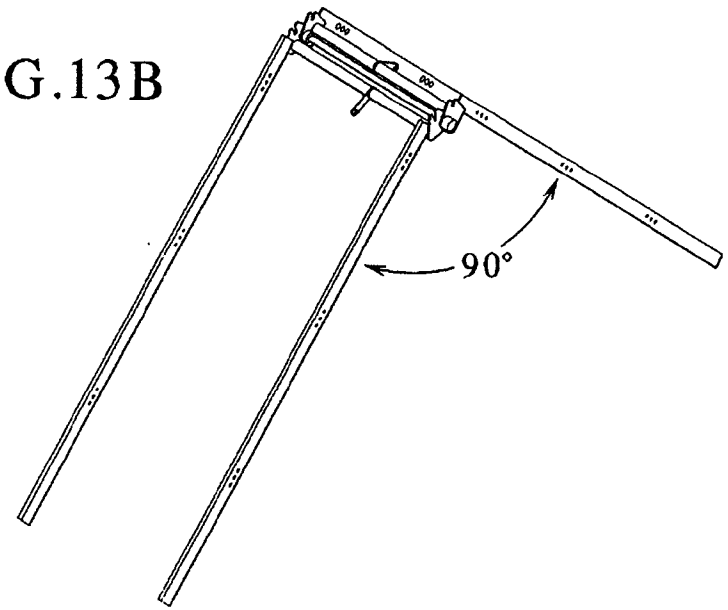
Figure 13C:
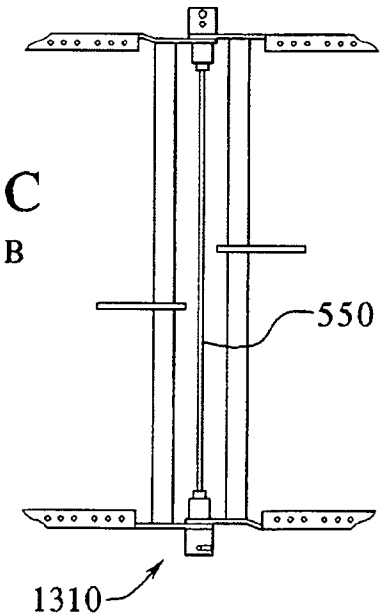
FIG. 13C illustrates Detail B of the top view of the center torsion bar assembly of FIG. 13A.
Figure 14A:
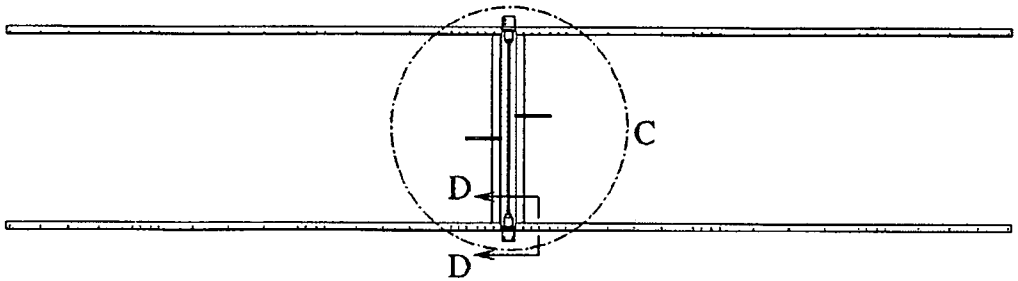
FIGS. 14A, 14B and 14C illustrate top, side and isometric views of the center torsion bar assembly for the folding table of FIGS. 1A–1D and 4A–4B in a zero degree (0°) position according to an embodiment of the present invention.
Figure 14B:
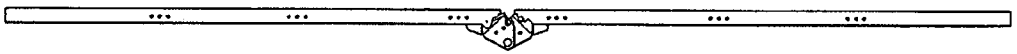
Figure 14D:
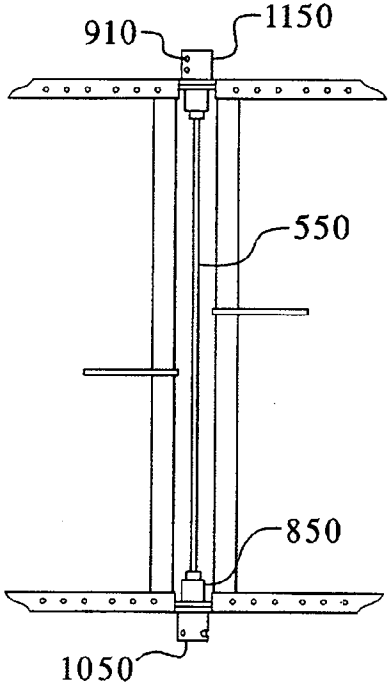
FIG. 14D illustrates Detail C of the top view of the center torsion bar assembly of FIG. 14A.
Figure 14E:
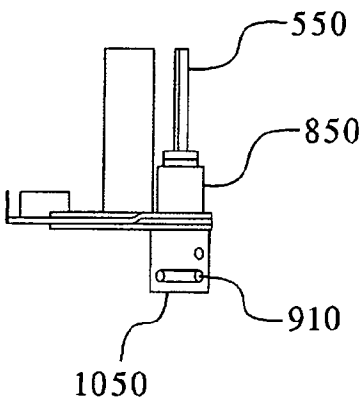
FIG. 14E illustrates an enlarged partial view along the line D—D of the top view of the center torsion bar assembly of FIG. 14A.
Figure 14C:
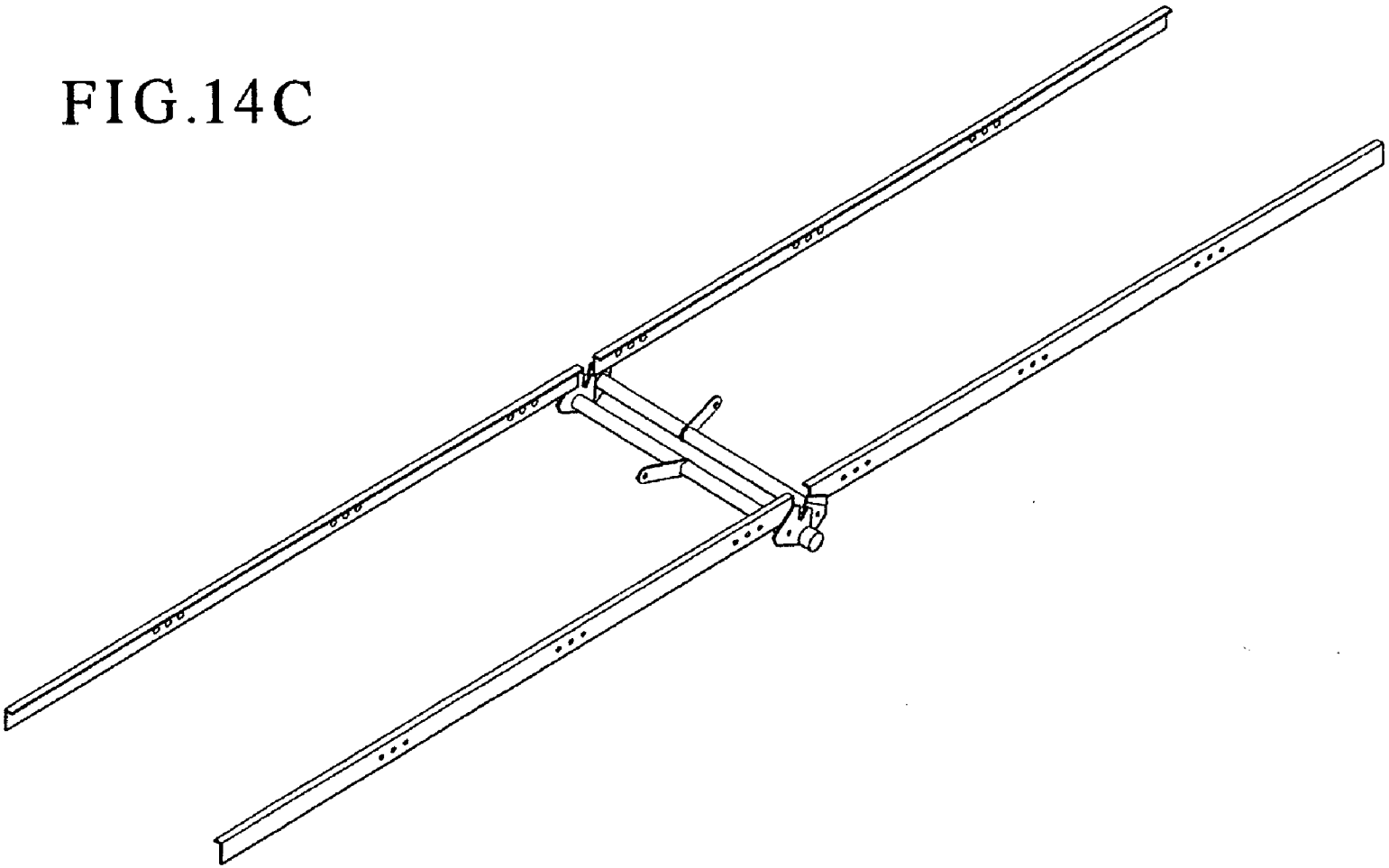

The clutch mechanism 560 permits the center torsion bar 550 to rotate freely and not build up stored energy as the mobile table travels from a fully folded closed position, shown in FIGS. 4B and 5D, to a half way unfolded position, shown in FIGS. 13A–13C, where each table section 5A and 5B approximately forms a forty five degree (45°) angle to the floor. In this position, the folding table frame structure 20A and 20B and table frame rails 25A, 25B, 27A and 27B form an angle that is approximate ninety degrees (90°) as shown in FIG. 13B.

At the ninety degree (90°) angle between the table frame structures 20A and 20B, the clutch mechanism 560 will engage the center torsion bar 550. Any further movement of the mobile folding table 100 and 400 in the unfolding direction will twist the engaged center torsion bar 550 thereby storing energy as the mobile table continues to the unfolded position 100 shown in FIGS. 1A, 1B, 1D and 14A–1C.

In the fully unfolded position, the table sections 5A and 5B are substantially parallel to the floor and are said to be in a zero degree (0°) position. In this position, the folding table frame structure 20A an 20B and table frame rails 25A, 25B, 27A and 27B are also parallel to the floor and are in the zero degree (0°) position. When the mobile table 100 is in the unfolded position, the center torsion bar 550 has its maximum amount of stored energy.

Additionally, the wheeled casters 30 of the end leg assemblies 300, which were facilitating the movement of the unfolding table 100, have lifted off the floor and allowed the unfolded table 100 to rest on the seat stool base 315 thereby allowing the unfolded table to maintain a good grip on the floor and prevent the unfolded table from wandering from its position. Conversely, when the unfolded table is lifted from the unfolded position by the operator, the hinge section 17 of the table will move vertically. The vertical movement of the center hinge section 17 will be translated to the leg assemblies 200 and 300 via the short, center leg and end leg drive links 8A, 8B, 40A, 40B, 45A and 45B to the center leg and end leg assemblies 200 and 300. The translated movement will force the leg assemblies 200 and 300 to pivot and swing inward as the mobile table 100 rises. The wheeled casters 30 of the end leg assemblies 300 will swing down and land on the floor and thereby transfer the weight of the folding table 100 onto the wheeled caster 30. The caster wheels will make it easier for the mobile table 100 to move and travel towards its folded table position 400.

In moving the unfolded table 100 to a folded position 400, the stored energy in the center torsion bar 550 preferably provides the operator with an additional or supplemental lifting force when lifting the unfolded table 100 to a folded position 400. This is advantageous, since the greatest amount of lifting force is required at the beginning of the folding process. The operator will benefit by needing to exert substantially less force than required by existing folding table designs. The center torsion bar 550 will continue to deliver its lifting assist force as the mobile folding table continues to fold towards the closed position 400 until the table again reaches the half way folded position shown in FIG. 13B where each table section 5A and 5B approximately forms a forty five degree (45°) angle to the floor and the frame structure 20A or 20B and table frame rails 25A, 25B, 27A and 27B form an angle that is approximate ninety degrees (90°). At this mid-way folded position, the center torsion bar 550 will have fully delivered it's stored energy in providing lifting assistance to the operator. Also, at this point the clutch mechanism 560 will disengage the center torsion bar 550. As the mobile table 100 and 400 continues to fold toward the completely folded position, the center torsion bar 550 will freely rotate since the clutch mechanism 560 has been disengaged. The center torsion bar 550 will not store energy again until the clutch mechanism 560 again engages the center torsion bar 550 in the half way table position shown in FIG. 13B when the mobile folding unfolding process is again repeated.

FIGS. 5C and 6 illustrates a partial section view of the center torsion bar assembly 600 including the clutch mechanism 560 according to one embodiment of the present invention. The clutch mechanism 560 preferably comprises a center torsion bar 550 with a hexagonal cross section mounted along the axis 10 of the central hinge pivot 17 of the mobile folding table 100 and 400. The center torsion bar 550 is preferably longer than the other outboard torsion bars and preferably extends beyond the frame rails 25A, 25B 27A and 27B. The longer length of the center torsion bar 550 increases the amount of torque provided by the center torsion bar 550 and enables the clutch mechanism 560 to be mounted on the outside of the hinge plates 19A and 19B and also provides convenient accessibility to the center torsion bar 550 and the clutch mechanism 560 in the event of damage or failure of the center torsion bar assembly 600.

Figure 9B:
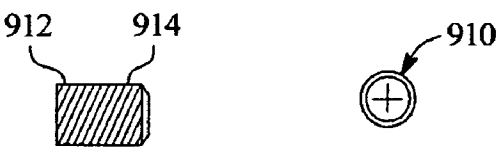
FIG. 9B illustrates front and side views of a dowel pin for the pin holder of FIG. 9A.
Figure 9A:
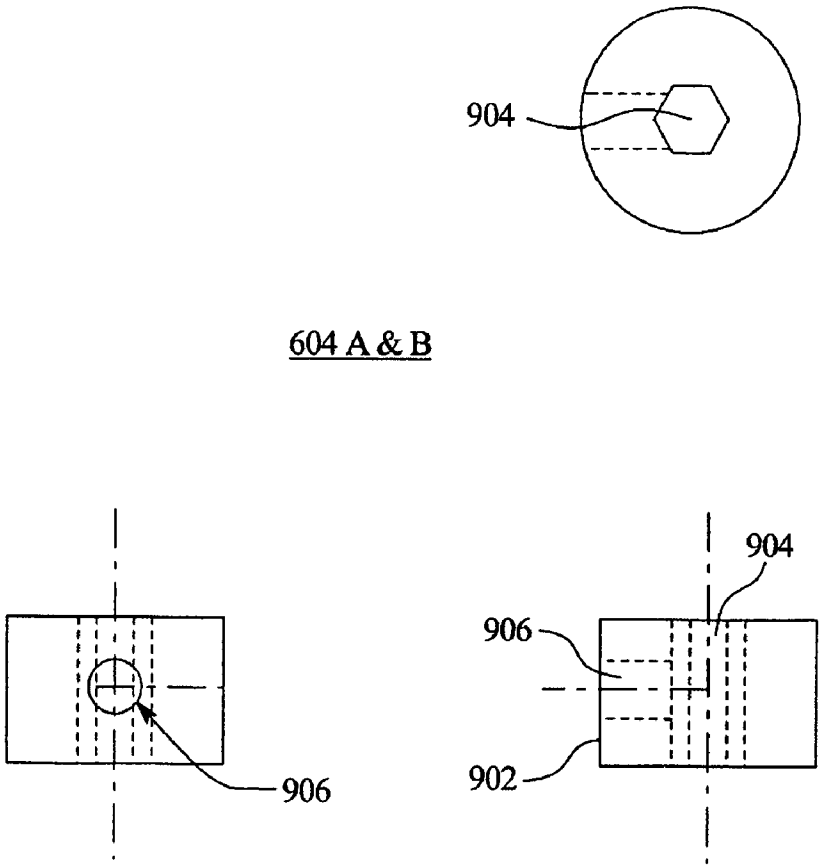
FIG. 9A illustrates top, front and side views of a pin holder for the center torsion bar assembly of FIG. 6 according to an embodiment of the present invention.

A pin holder 604A or 604B, shown in FIG. 9A constructed of steel or similar material and having a hexagonal through-hole 904 is placed at both ends 654A and 654B of the long center torsion bar 550 to capture the ends 654A and 654B of the center torsion bar 550 and thereby transfer energy to the table frame structure 20A and 20B. The pin holders 604A and 604B are preferably identical in construction and material. The pin holders 604A and 604B further include a dowel pin hole or aperture 906 that extends partially into the pin holder 604A and 604B and is preferably located in the pin holder 604A and 604B to be perpendicular to the axis of the center torsion bar 550. The dowel pin hole 906 preferably receives a dowel pin 910, shown in FIG. 9B, where one end 912 of the dowel pin 910 rests against a flat side of the center torsion bar 550 inside the pin holder 604A and 604B. Another hole can also be added if desired along the same axis as the dowel pin to ease the removal of the dowel pin 910.

The dowel pin 910 is preferably metallic, such as steel, and may have chamfered ends or a spiral cut along its surface to make inserting or removing the dowel pin 910 into and out of the pin holder 604A and 604B easier. The other free end 914 of the dowel pin 910 preferably extends beyond the outside surface 902 of the pin holder 604A or 604B such that the dowel pin 910 can come into operative contact with one of two pin guides 1050 and 1150, shown in FIGS. 10 and 11.

Figure 10:
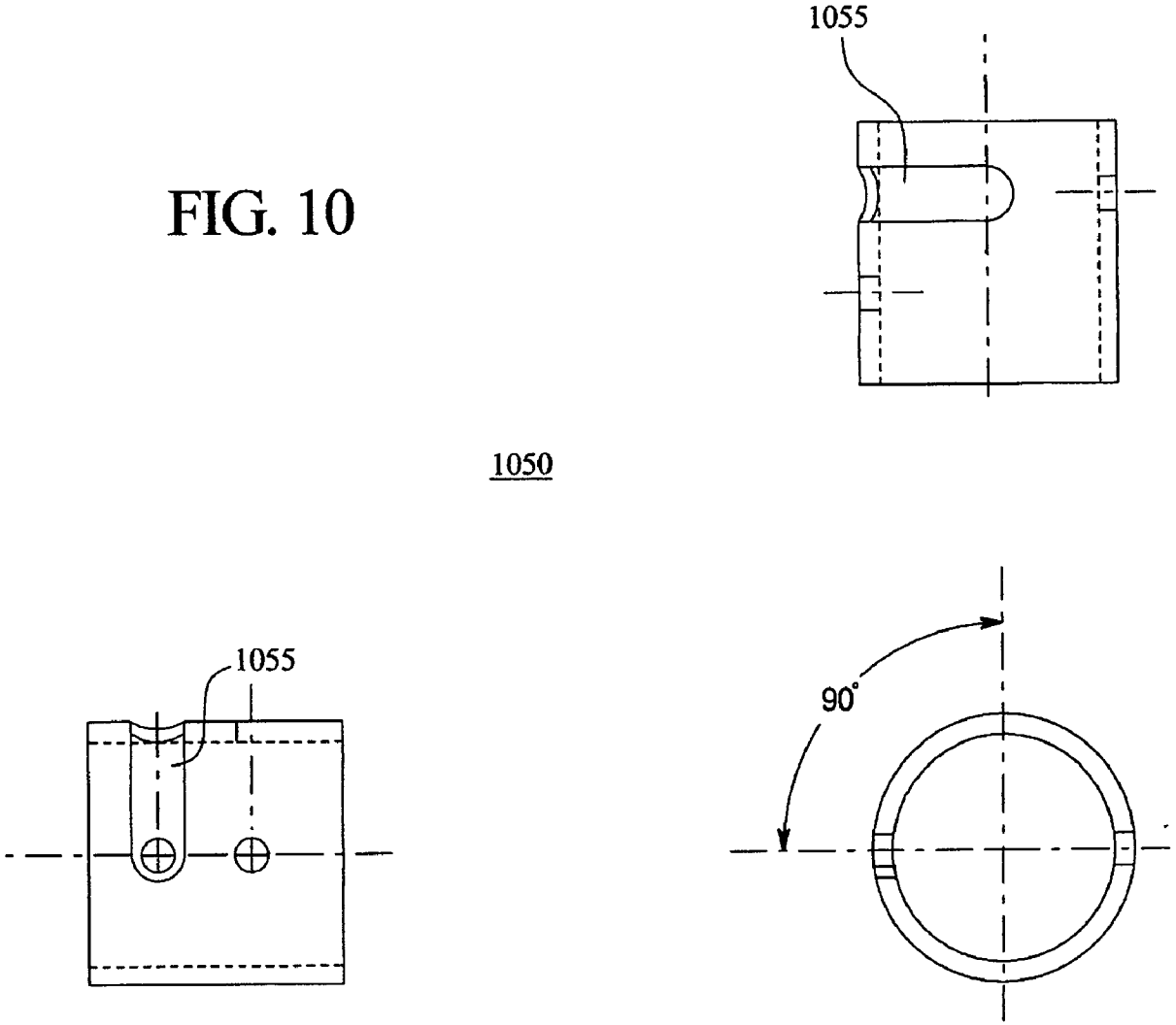
FIG. 10 illustrates top, front and side views of a slotted pin guide for the center torsion bar assembly of FIG. 6 according to an embodiment of the present invention.
Figure 11:
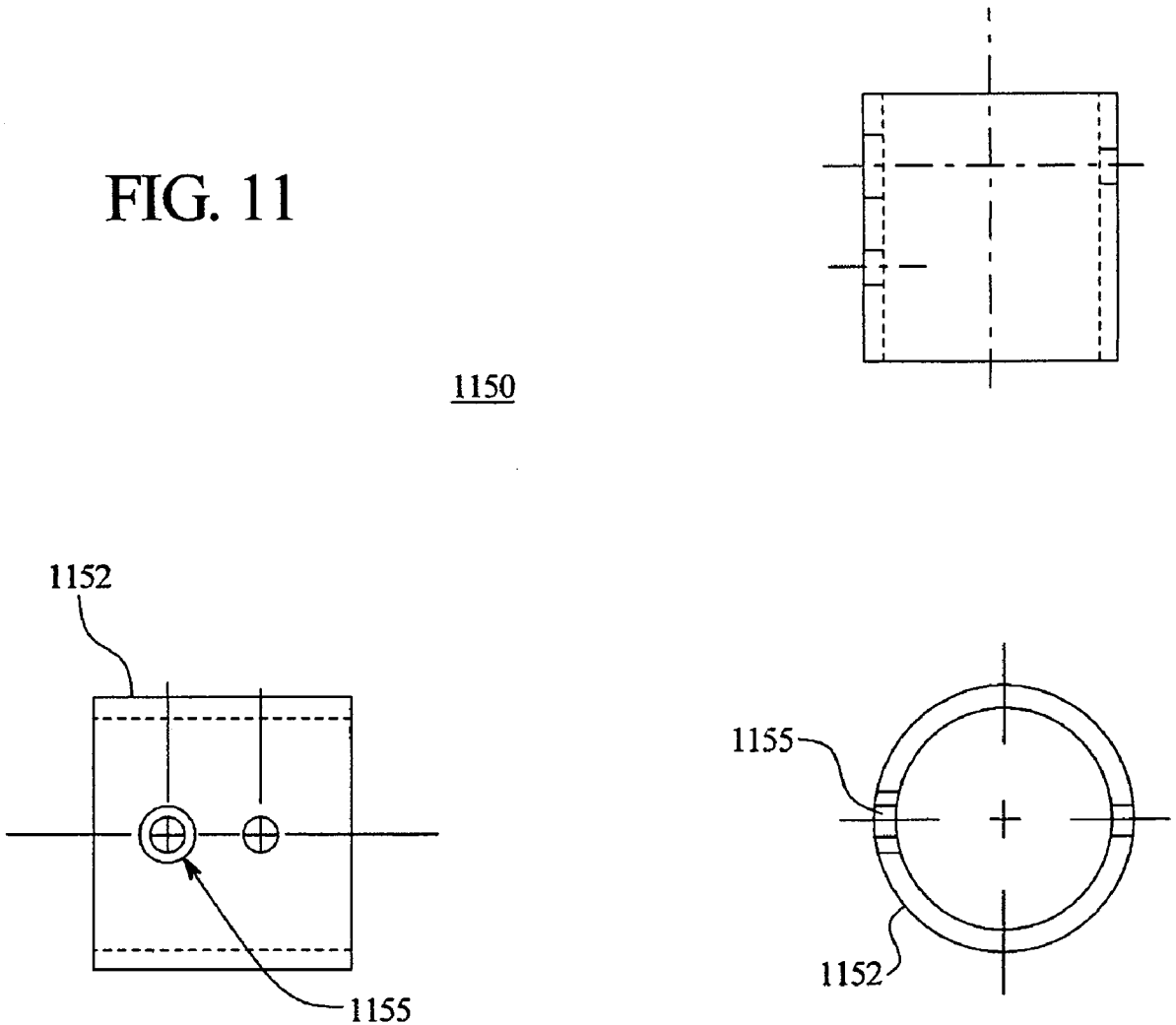
FIG. 11 illustrates top, front and side views of an unslotted pin guide for the center torsion bar assembly of FIG. 6 according to an embodiment of the present invention.

The pin guides 1050 and 1150, shown in FIGS. 6, 10 and 11 are preferably round tubes with an inside diameter slightly larger than the outside diameter of the center torsion bar or pin holders 604A and 604B. The clutch mechanism 560 preferably comprises a slotted pin guide 1050 with a slot 1055 that is machined into the wall of the tube to thereby allow the dowel pin 910 to pass into and travel in the slot 1055. The clutch mechanism 560 also comprises a second unslotted pin guide 1150 that preferably has a hole 1155 drilled into its wall 1152 with a diameter slightly larger than the dowel pin 910. Both the slotted and unslotted pin guides 1050 and 1150 are preferably welded to the outermost hinge plate 19A and 18B on either side of the mobile foldable table 100 and 400 concentric with the folding axis 10 of the mobile table 100 and 400.

The unslotted pin guide 1150 serves as a rigid attachment point for one end 654B of the center torsion bar 550. The opposite end 654A of the center torsion bar 550 is aligned with the slotted pin guide 1050. The slotted pin guide 1050 is also preferably welded or otherwise securely attached to the outermost hinge plate 19A of the mobile foldable table 100 and 400 concentric with the folding axis 10 of the mobile table 100 and 400 in a position that allows the dowel pin 910 to travel freely inside the slot 1055 as the mobile table 100 and 400 is unfolded from its completely folded position at zero degrees (0°), shown in FIGS. 4A and 4B, to a mid-way partially unfolded position at preferably ninety degrees (90°) shown in FIG. 13B. In this position, the plane of the table tops 5A and 5B is approximately forty-five degrees (45°) to the floor, and approximately ninety degrees (90°) with respect to each other.

In the partially folded or unfolded position of FIG. 13B, the dowel pin 910 contacts and engages one end 1310 of the slot 1055, as shown in FIG. 13C. In this manner, the clutch mechanism 560 is now engaged at this position and will restrict any further free rotation of the center torsion bar 550 if the mobile table 100 and 400 is further unfolded. If the mobile table 100 and 400 is further unfolded from this position, the center torsion bar 550 will twist and store energy, and slow the rate at which the mobile table 100 and 400 is unfolding. Unless the operator intervenes, the weight and momentum of the unfolding mobile table 100 and 400 will further flex the center torsion bar 550 thereby storing energy until the mobile table is fully unfolded at 180 degrees as shown in FIGS. 1A–1D and 14A–14C.

Figure 7B:
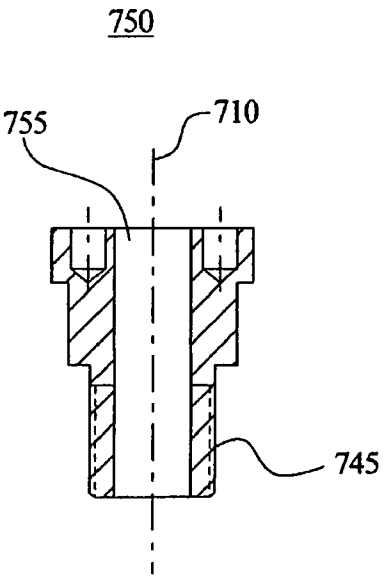
FIG. 7B illustrates a front section view along the line A—A of the male socket of FIG. 7A.
Figure 7A:
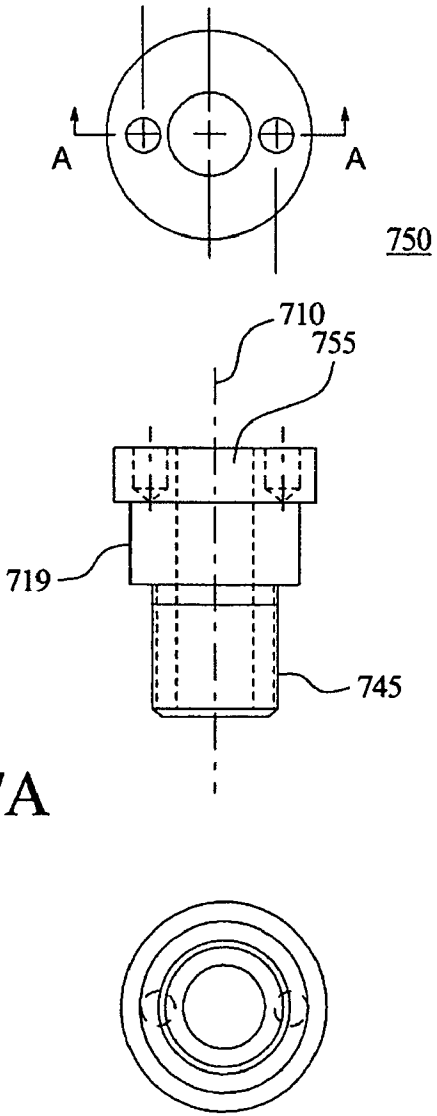
FIG. 7A illustrates top, front and bottom views of a male shoulder socket for the center torsion bar assembly of FIG. 6 according to an embodiment of the present invention.
Figure 8B:
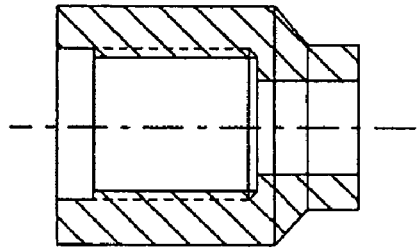
FIG. 8B illustrates a front section view along the line A—A of the female socket of the of FIG. 8A.
Figure 8A:
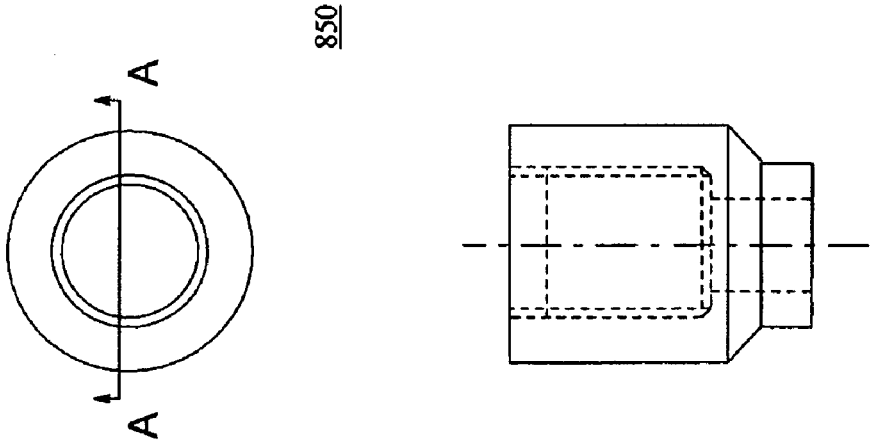
FIG. 8A illustrates top and front views of a female socket for the center torsion bar assembly of FIG. 6 according to an embodiment of the present invention.

Additionally, since the center torsion bar 550 is coincident with the hinge axis 10 of the folding mobile table 100 and 400, the center torsion bar assembly further comprises a surface 719, shown in FIGS. 6, 7A and 7B, about which the table frame hinges or plates 18A, 18B, 19A and 19B can pivot. The center torsion bar assembly of the present invention comprises pivot hinge plates 18A, 18B, 19A and 19B having holes with a sufficiently large diameter to let the center torsion bar pass through the main axis 10 of the shoulder male socket 750 shown in FIGS. 7A–7B. The shoulder socket 750 passes through the corresponding hole in both hinge plates 18A, 18B, 19A and 19B on each set of table frame rails 25A, 25B, 27A and 27B. The shoulder socket 750 preferably extends slightly beyond the innermost hinge plates 18A and 19B to allow clearance for the hinge plates 18A, 18B, 19A and 19B to pivot freely. The hinge plates 18A, 18B, 19A and 19B may also be separated by a flat washer 619 with a larger inside diameter than the shoulder socket 750. The threaded portion of the shoulder socket 750 has a through hole 755, shown in FIGS. 7A and 7B, along its axis 710 large enough to allow the center torsion bar 550 to pass through and a larger diameter portion 745 accepts and connects to a female socket 850 shown in FIGS. 8A and 8B.

The female socket 850 is preferably welded or securely attached by other means to a center torsion bar cover tube 650 with an identical female socket 850 attached to the opposite end of the cover tube 650. The cover tube 650 should span the distance between the table frame rails 25A, 25B, 27A and 27B and can function as a protective barrier around the center torsion bar 550. The cover tube 650 can protect the center torsion bar 550 from wear and tear and may additionally protect a table operator from injury due to the failure and rupture of the center torsion bar 550 during the loading or unloading phase of the mobile folding table 100 and 400.

Figure 12:
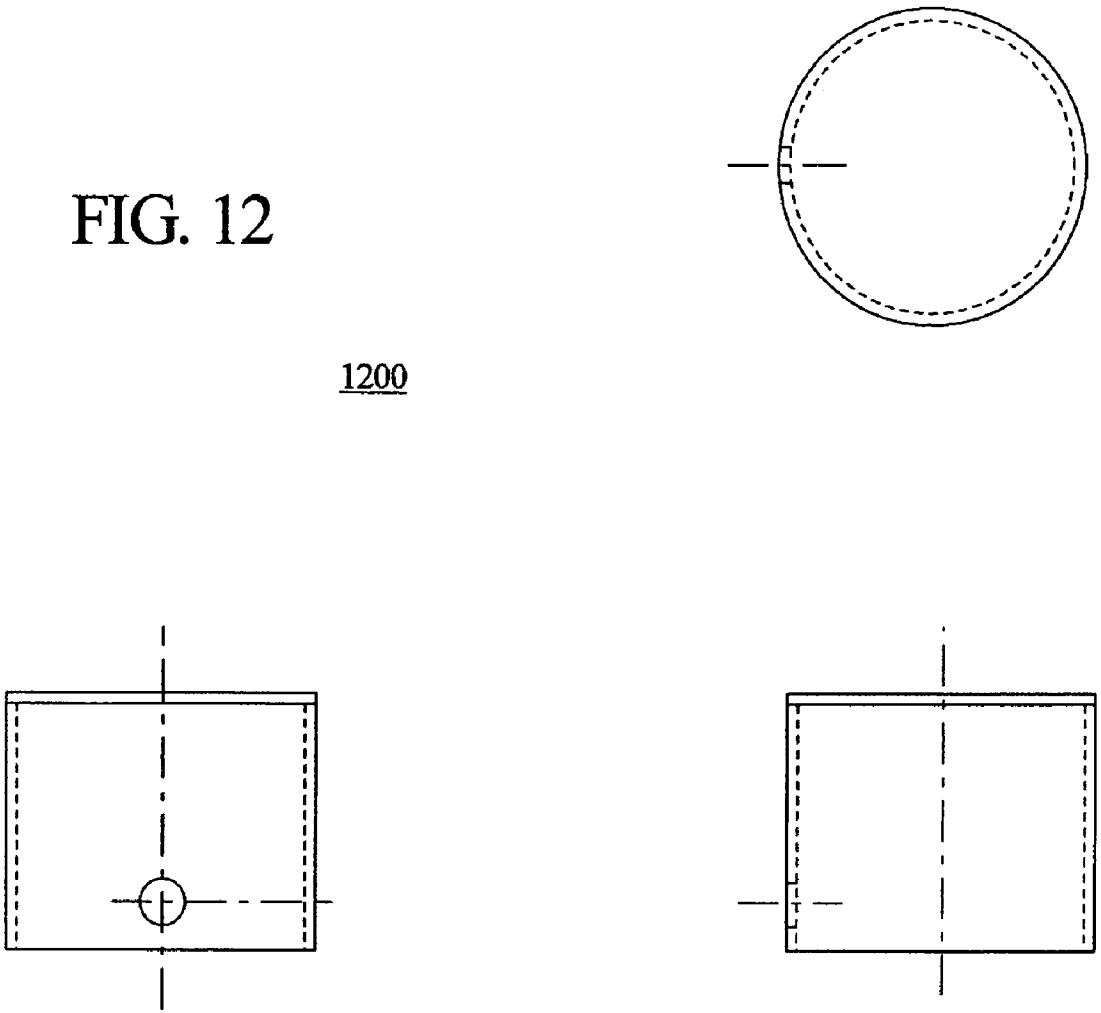
FIG. 12 illustrates top, front and side views of a pin guide end cap for the center torsion bar assembly of FIG. 6 according to an embodiment of the present invention.

The clutch mechanism 560 also comprises pin guide end caps 1200, shown in FIG. 12, at both ends 520 and 530, shown in FIG. 6. The end caps 1200 serve as a means for restricting unsafe access to the moving parts inside the clutch mechanism 560 and for cosmetically sealing the clutch mechanism 560. The end caps 1200 are preferably fastened to the slotted and unslotted pin guides 1050 and 1150 and are configured to completely enclose or cover the ends 654A and 654B of the center torsion bar 550 and its pin holder 604A and 604B. The end caps 1200 can be configured to allow for their removal in the event that the center torsion bar clutch mechanism requires servicing or repair.

Figure 15A:
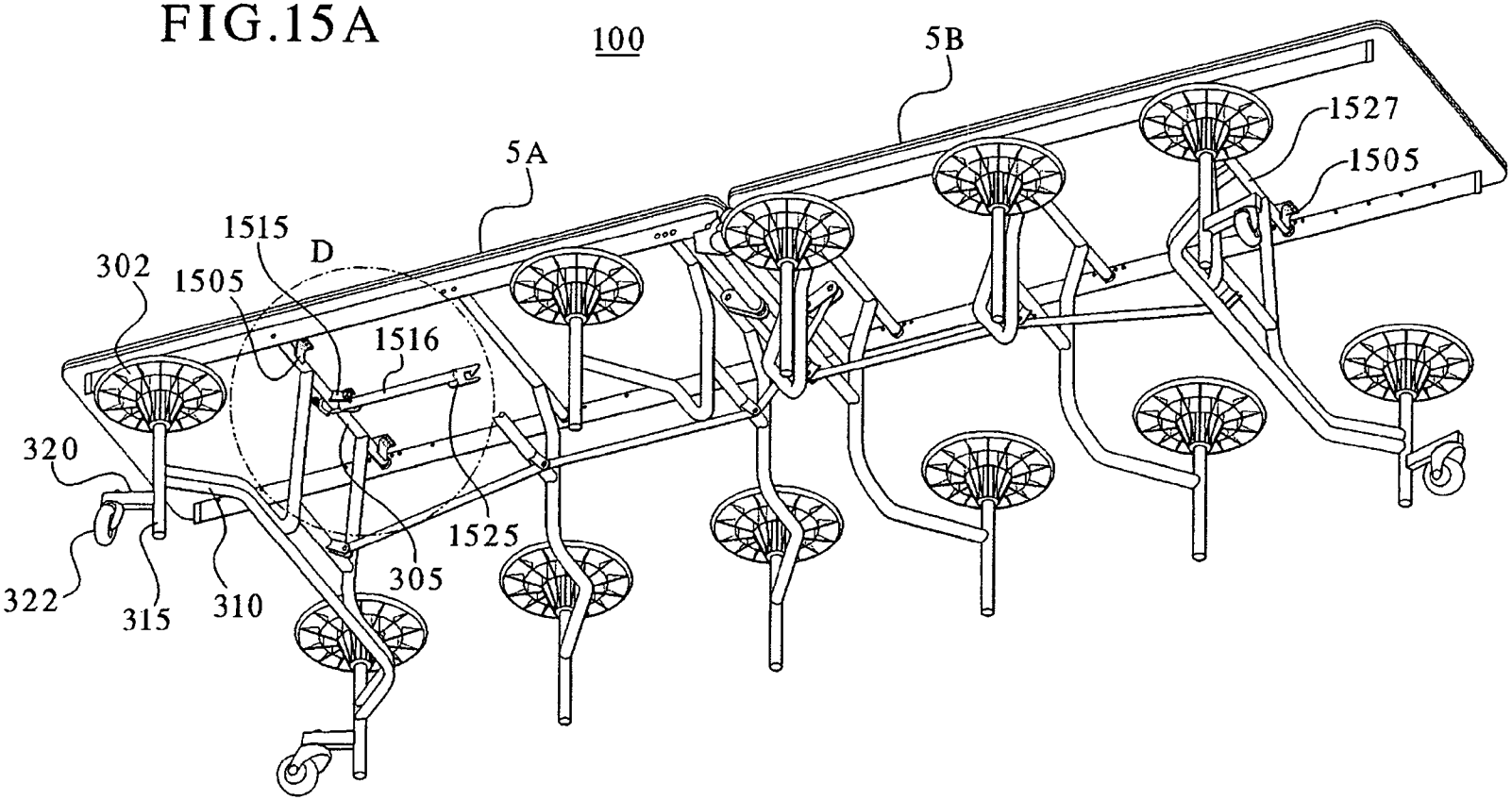
FIG. 15A illustrates an isometric underside view of an unfolded folding table assembly with a stability locking mechanism and an end leg support bracket according to an embodiment of the present invention.
Figure 15B:
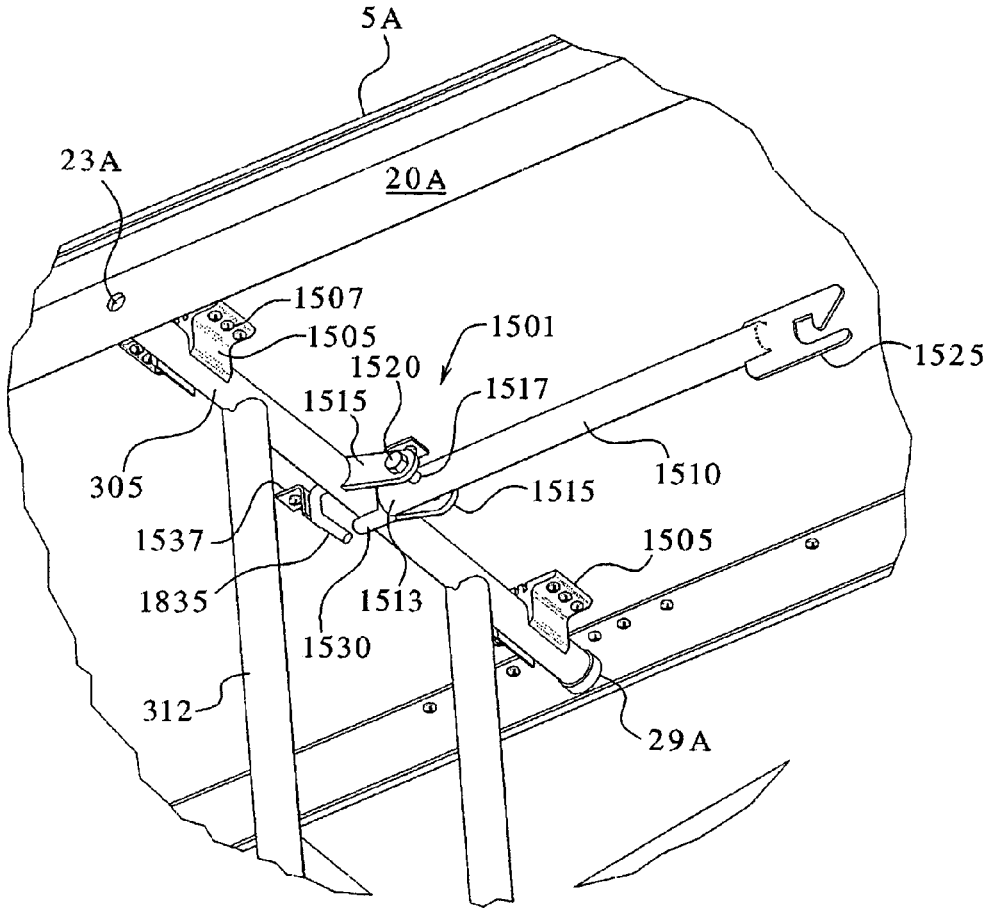
FIG. 15B illustrates Detail D of the stability locking mechanism and the end leg support bracket of FIG. 15A.
Figure 15C:
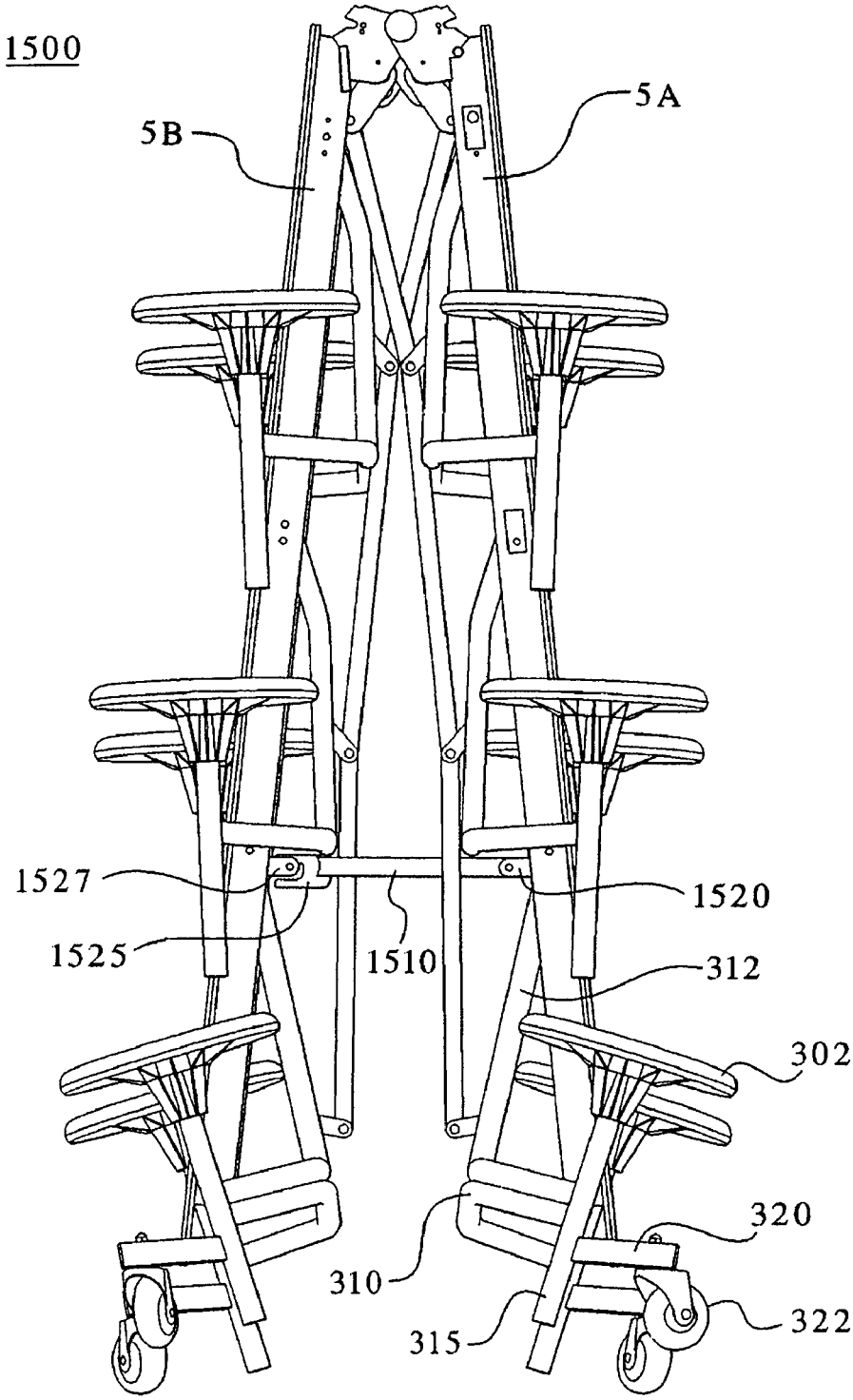
FIGS. 15C and 15D illustrate rear isometric front and underside views of the folding table assembly of FIG. 15A in a semi-closed position with the stability locking mechanism engaged.
Figure 15D:
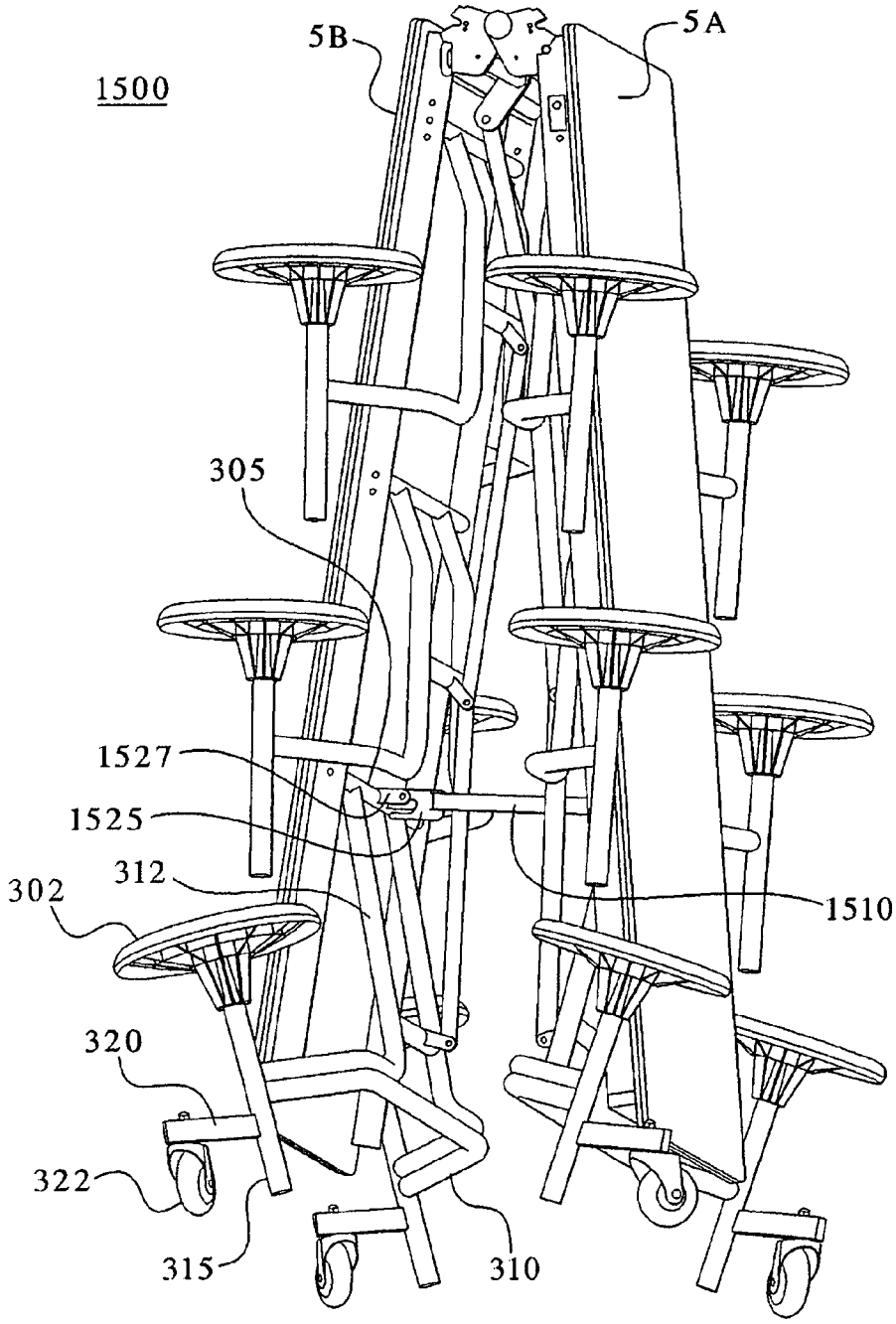
Figure 16:
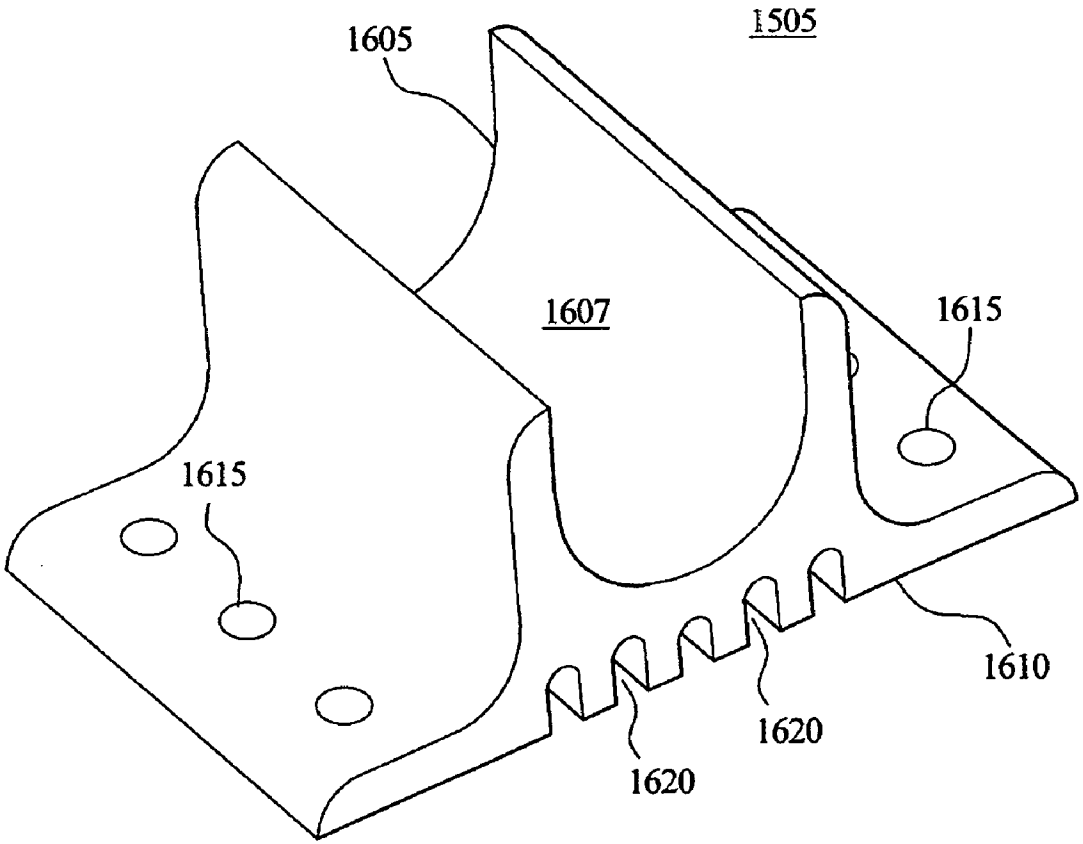
FIG. 16 illustrates an isometric view of the end leg support bracket of FIGS. 15A and 15B.
Figure 17:
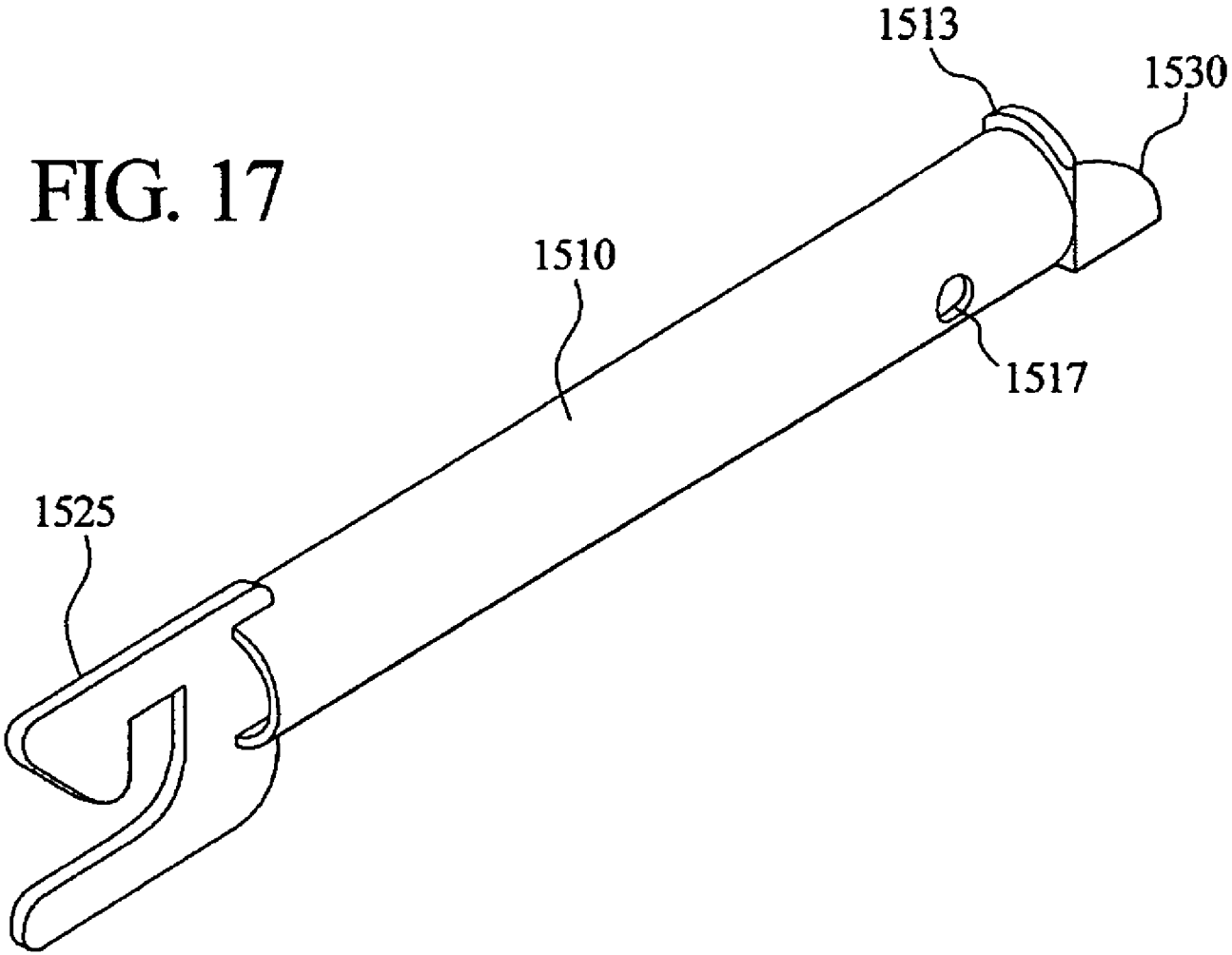
FIG. 17 illustrates a lock mechanism arm of the stability locking mechanism of FIGS. 15A and 15B.

FIGS. 15A–15B and 16 show an embodiment of an end leg support bracket 1505 that can be used with the end leg assembly 300 to more evenly distribute the weight of the folding table assembly 100 on the end leg hinge 305 as the table moves between an unfolded position and a first folded position, as shown in FIG. 4B, or a second folded position, as shown in FIGS. 15C and 15D. The end leg support brackets 1505 can also be used to properly position and to maintain proper positioning of the end leg assembly 300 under the table sections 5A and 5B. FIG. 15B shows detail D which illustrates more clearly a preferred positioning of the end leg support bracket 1505 between the end leg hinge 305 and the underside surface of the table sections 5A and 5B. FIG. 16 shows an isometric front view of the end leg support bracket 1505. In one embodiment, the end leg support bracket 1505 comprises an upper hinge section 1605, a substantially flat bracket mounting surface 1610, and bracket fastening bores 1615.

The upper hinge or saddle section 1605 preferably has a semi-circular or U-shaped configuration to complimentarily or concentrically accept the end leg hinge 305, as shown in FIG. 15A and 15B. Other configurations may be used that can accept and compliment the shape of the end leg hinge 305. The upper hinge section 1605 extends across the width of the end leg support bracket 1505 such that a maximum contact surface area 1607 of the support bracket 1505 comes into contact with the end leg hinge tube 305. The large contact surface area 1607 thereby provides a load bearing area on the support bracket 1505 which is free from concentrated loads or encounters a minimum of concentrated loads as the table 100 moves between an unfolded position and a folded position. The large contact surface area 1607 also helps minimize scratching or marring of paint material on the surface of the end leg hinge tube 305 that contacts the support bracket 1505.

The bracket mounting surface 1610 is preferably flat so as to mount flush with the underside surface of the table sections 5A and 5B, as shown in FIGS. 15A and 15B. The substantially flat nature of the bracket mounting surface 1610 provides a sturdy connection to the underside surface of the table sections 5A and 5B without limiting or obstructing the movement of the end leg assemblies 300. The bracket mounting surface 1610 is can be flat and continuous or can be traversed by one or more flexing slots 1620, as shown in FIG. 16. The flexing slots 1620 enable the end leg support bracket 1505 to dynamically flex or move as the end leg hinge 305 rotates within the upper hinge section 1605 as the table 100 moves between an unfolded position and a folded position. The flexing aspect enables the end leg support bracket 1505 to handle variations in weight loads encountered as the table 100 moves between an unfolded position and a folded position. The bracket fastening bores are preferably cylindrical apertures that extend through the end leg support bracket 1505 to permit the insertion of fasteners 1507, such as screws, that will secure the end leg support bracket 1505 to the underside surface of the table sections, as best shown in FIG. 15B. Other known fastening methods may be used as well.

The end leg support bracket 1505 is preferably made of a plastic based material, such as molded polyvinyl chloride (PVC) material to provide flexibility and minimize scratching of the end leg hinge tube 305. The plastic based material also prevents gouging of the end leg hinge tube 305 which can lead to rust and added friction in the operation of the end leg hinge tube 305. Though less preferred, other materials, such as metallic based end leg support brackets 1505, may be used even if such materials may sometimes lead to gouging of the end leg hinge tube 305 after repeated use.

FIGS. 15A–15D and 17–18 show an embodiment of a stability lock mechanism 1501 used to prevent the table 100 from reaching a fully closed shipping position 400, such as that shown in FIG. 4B. The foldable table 100 can have two closed positions appropriate for different uses or purposes. When the table 400 is prepared for shipping, the table is preferably closed as tightly as possible in a first closed position in order to reduce space requirements and shipping costs. FIG. 4B shows a table 400 in a first closed shipping position prepared for shipping to a location. In the first closed shipping position, the end leg assemblies 300 and associated caster wheels 322 are pulled in and positioned as closely as possible. The table configuration 400 is tightly packed for shipping purposes but can easily become unstable and thus is prone to tipping over and falling. If the table falls, it may cause damage to the table itself, the floor underneath or surrounding objects. Such a table fall may even cause injury to individuals in the vicinity of the table.

As shown in FIGS. 15C and 15D, the folding table 100 can also be set in a second closed position 1500 when not being shipped. Setting the folding table 100 in the second closed or semi-closed position 1500 enables the table 100 to be moved around for storage or repositioning purposes during normal table use. In the second closed position 1500, the stability lock mechanism 1501 maintains the folding table 100 in a position where the table 100 is not fully closed but is in a semi-closed position. The stability lock mechanism 1501 prevents the table 100 from reaching the unstable closed shipping position 400. When engaged, the stability lock mechanism 1501 spreads out to maintain the table caster wheels 322 in the semi-closed table position 1500. The stability lock mechanism 1501 securely links the two table section 5A and 5B to create a wider wheelbase or table footprint resulting in a safe and stable semi-closed folding table 100.

As shown in FIGS. 15A–15B and 17–18 the stability lock mechanism 1501 comprises a lock catch 1525, such as a stamped sheet metal hook, attached to one end of a lock mechanism arm 1510. The lock mechanism arm 1510 also comprises a lock tab 1530 at its lock arm base 1513 and a pivot point 1517 situated near the lock arm base 1513 between the lock catch 1525 and the lock tab 1530. The lock mechanism arm 1510 is preferably attached to an end leg hinge tube 305 of one of the end leg assemblies 300. The stability lock mechanism 1501 also comprises a lock yoke 1515 and pivot point fastener 1520 that attach the lock mechanism arm 1520 to the end leg hinge tube 305 at the lock arm pivot point 1517, as best shown FIG. 15B. The lock yoke 1515 is preferably welded to the end leg hinge tube 305, though other known fastening means may be used instead to securely attach the lock yoke 1515 to the end leg hinge tube 305. The pivot point fastener 1520 can be a bolt and nut combination or other known fastening means that will permit the lock mechanism arm 1510 to be attached and to freely pivot about the pivot point 1517.

As shown in FIGS. 15A, 15C and 15D, the stability lock mechanism 1501 further comprises a lock catch receiver 1527 located on the end leg hinge tube 305 of the opposite end leg assembly 300 of the folding table 100. The lock catch receiver 1527 is preferably positioned on the end leg hinge tube 305 such that it is aligned with the lock catch 1525 and receives the lock catch 1525 when the table 100 is folded to thereby set and maintain the folded table 100 in the stable semi-closed position 1500.

Figure 18:
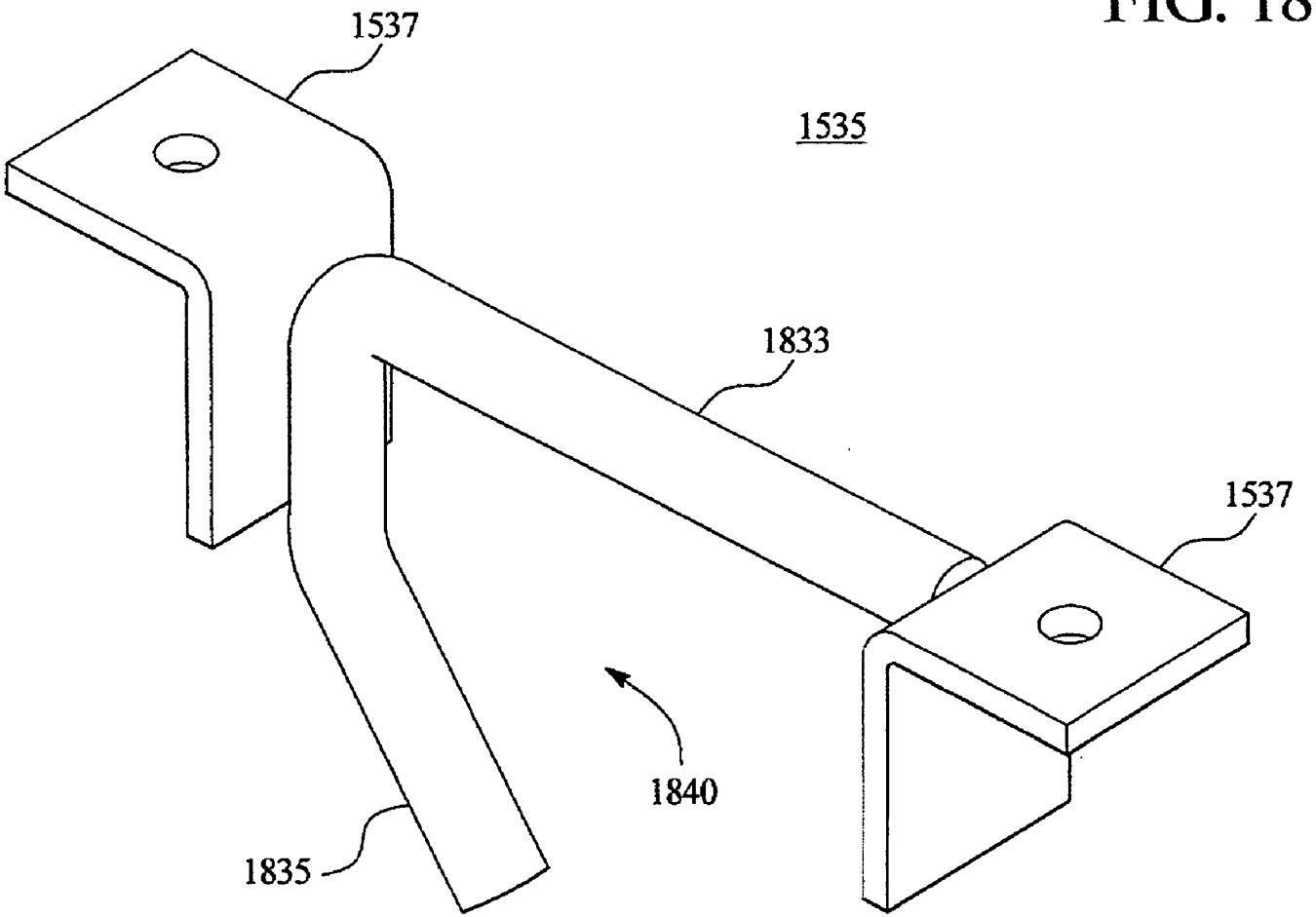
FIG. 18 illustrates a lock backstop of a stability locking mechanism according to an embodiment of the present invention.

As shown in FIGS. 15B and 18, the stability lock mechanism 1501 also comprises a lock backstop 1535 that includes a mounting backstop base 1833 that is fastened or bracketed 1537 to the underside surface of the table section 5A and a backstop arm 1835 with a generally hook-like configuration. As best shown in FIG. 15B, the lock backstop 1535 preferably straddles the end leg hinge tube 305 of the end leg 300. The backstop arm 1835 extends from the backstop mounting base 1833 downward and toward the lock tab 1530.

The lock backstop 1535, the end leg hinge tube 305, the lock tab 1530 and the lock arm base 1513 cooperate to maintain the lock mechanism arm 1510 in a substantially horizontal orientation and parallel to the floor below as the table 100 is moved between a semi-closed and open position. The stability lock mechanism 1501 is thus a safety feature of the table 100 since a user or operator is not required to manually line up the lock mechanism arm 1510 as the table 100 is being moved to a semi-closed position.

The lock tab 1530 normally contacts the end leg hinge tube 305 throughout much of its motion and prevents the lock arm from swinging below a horizontal orientation relative to the floor below. This aspect is a result of the orientation and position of the lock mechanism arm 1510 on the end leg hinge tube 305, via the lock yoke 1515. The lock tab 1530 loses contact with the end leg hinge tube 305 when the table is nearly opened. For example, the table position where the angle between the two table sections 5A and 5B is about one hundred sixty degrees (160°). At this point, as the table continues to travel to a fully opened position of about one hundred eighty degrees (180°), the backstop mounting base 1833 provides a mechanism to pivot the lock mechanism arm 1510 so as to maintain its horizontal orientation under the table 100. The backstop mounting base 1833 contacts an end of the lock arm base 1513 to properly pivot and position the lock mechanism arm 1510. In returning the table to a semi-closed position, the lock mechanism arm 1510 can thus be maintain in a horizontal orientation throughout the table's movement.

In the moving the table from a fully opened position, as shown in FIG. 15A, to a semi-closed position 1500, shown in FIGS. 15C–15D, the lock mechanism arm 1510 is maintained in a horizontal or parallel orientation to the floor below throughout the table's movement. This will enable the lock mechanism arm 1510 to remain aligned with the lock catch receiver 1527 located on the end leg hinge tube 305 of the opposite end leg assembly 300 of the folding table 100 as the table 100 is moved from an open use position to a semi-closed position 1500. The stability lock mechanism 1501 obviates the need for a user or operator to manually align or line up the lock mechanism arm 1510 with the lock catch receiver 1527 as the table 100 is being folded to a semi-closed position 1500.

As the table 100 is moved from the open position to closed position, gravity causes a downward motion of the lock mechanism arm 1510 about the lock arm pivot point 1517. As the lock mechanism arm 1510 pivots, the lock tab 1530 will enter a backstop hold space or area 1840 in the lock backstop 1535 between the backstop arm 1835 and mounting backstop base 1833. The lock tab 1530 will enter the backstop hold area 1840 when the angle between the two table sections 5A and 5B is about one hundred sixty degrees (160°). The lock tab 1530 will remain in the backstop hold area 1840 as the table 100 continues toward its semi-closed position 1500. If a user or operator attempts to swing the lock mechanism arm 1510 up and out of the way towards the table, to thereby reach a fully closed shipping position, the lock tab 1530 will come into contact with the backstop arm 1835. This creates a physical obstruction such that the backstop arm prevents the lock mechanism arm 1510 from being swung out of the way during folding. Otherwise, a user might inadvertently swing the lock mechanism arm 1510 out of the way and set the table in the unstable shipping position 400, potentially causing injury if the table where to fall.

The stability lock mechanism 1501 also provides a way for a user or operator to intentionally bypass the stability lock mechanism 1501 so that the table 100 can be folded from an open position, past the semi-closed position 1500, shown in FIGS. 15C–15D, to the fully closed shipping position 400, shown in FIG. 4B. Initially, the stability lock mechanism is preferably only bypassed when the table is substantially open, as shown in FIG. 15A, and is being folded to a closed position. As the table is folded from the open position, a user or operator can swing the lock mechanism arm 1510 up towards the table such that the lock tab 1530 does not enter the backstop hold area 1840 as the table 100 continues folding toward the closed position. In this manner, the lock tab 1530 will not come into contact with the backstop arm 1835 since the lock tab 1530 did not enter the backstop hold area 1840 and the lock mechanism arm 1510 will not hook onto the lock catch receiver 1527. This bypass option is preferably only available when the table is nearly in its fully open position. In one embodiment, the bypass option is only available when the angle between the two table sections 5A and 5B is in the range of about one hundred sixty degrees (160°) to one hundred eighty degrees (180°).

The invention has been described and illustrated with respect to certain preferred embodiments by way of example only. Those skilled in that art will readily recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

We claim:

1. A folding table in combination with a folding table assembly for assisting in the transition of a folding table between an open position and a closed position, said folding table assembly comprising:

a folding table comprising a first table section hingedly connected to a second table section; wherein an open position is when said first and second table sections are substantially horizontal; and wherein a closed position is when said first and second table sections are substantially vertical;

a center torsion bar mechanism comprising a clutch mechanism and a center torsion bar coupled to said first table section such that said folding table folds relative to said second table section about said center torsion bar;

a first end of said center torsion bar fixed to said second table section and an opposite second end of said center torsion bar moveably coupled to said first table section via said clutch mechanism;

said clutch mechanism engaging said center torsion bar at a first semi-folded position as said table is unfolded from said closed position;

said center torsion bar storing folding potential energy between said first semi-folded position and said open position as said folding table continues unfolding to said open position;

said center torsion bar adapted to provide a lifting force between said open position and a second semi-folded position as said folding table is folded from said open to said closed position; and wherein said lifting force is provided via release of said stored folding potential energy in said center torsion bar until said clutch mechanism disengages said center torsion bar at said second semi-folded position as said table continues to fold to said closed position.

2. The folding table assembly of claim 1, wherein said first semi-folded position defines an engage angle between said first and second table section.

3. The folding table assembly of claim 2, wherein said second semi-folded position defines a disengage angle between said first and second table section.

4. The folding table assembly of claim 2, wherein said engage angle is about ninety degrees.

5. The folding table assembly of claim 3, wherein said disengage angle is about ninety degrees.

6. The folding table assembly of claim 3, wherein said engage and said disengage angle are identical.

* * * * *